US008200103B2

(12) United States Patent
Sasaki et al.

(10) Patent No.: US 8,200,103 B2
(45) Date of Patent: Jun. 12, 2012

(54) IMAGE FORMING SYSTEM

(75) Inventors: Ichiro Sasaki, Toride (JP); Akinobu Nishikata, Kashiwa (JP); Mitsuhiko Sato, Kashiwa (JP); Hidenori Sunada, Toride (JP); Manabu Yamauchi, Kashiwa (JP); Takayuki Fujii, Tokyo (JP); Naoto Watanabe, Abiko (JP); Shunsuke Nishimura, Toride (JP)

(73) Assignee: Canon Kabushiki Kaisha (JP)

( * ) Notice: Subject to any disclaimer, the term of this patent is extended or adjusted under 35 U.S.C. 154(b) by 144 days.

(21) Appl. No.: 11/469,810

(22) Filed: Sep. 1, 2006

(65) Prior Publication Data

US 2007/0086794 A1 Apr. 19, 2007

(30) Foreign Application Priority Data

Sep. 6, 2005 (JP) ..... 2005-258308

(51) Int. Cl.
*G03G 15/00* (2006.01)

(52) U.S. Cl. ..... 399/16; 399/18; 399/19; 399/391; 271/9.01; 271/9.02; 271/9.04; 271/9.13

(58) Field of Classification Search ..... 399/16, 399/18, 19, 391; 271/9.01, 9.02, 9.04, 9.13
See application file for complete search history.

(56) References Cited

U.S. PATENT DOCUMENTS

| | | | | |
|---|---|---|---|---|
| 4,517,221 | A * | 5/1985 | Holl | 427/8 |
| 4,693,590 | A * | 9/1987 | Umeda | 399/84 |
| 5,933,677 | A * | 8/1999 | Lee | 399/20 |
| 5,995,722 | A * | 11/1999 | Kishida | 358/1.15 |
| 6,011,936 | A * | 1/2000 | Kaneko | 399/21 |
| 7,380,780 | B2 | 6/2008 | Sasaki et al. | |
| 2004/0120000 | A1 * | 6/2004 | Onuma et al. | 358/1.14 |
| 2005/0082737 | A1 * | 4/2005 | Sasaki et al. | 271/9.12 |
| 2005/0151772 | A1 * | 7/2005 | Oishi | 347/16 |

FOREIGN PATENT DOCUMENTS

| | | | |
|---|---|---|---|
| JP | 2-309375 | A | 12/1990 |
| JP | 3-174167 | A | 7/1991 |
| JP | 07-92745 | A | 4/1995 |
| JP | 08-27559 | B2 | 3/1996 |
| JP | 2005-121886 | A | 5/2005 |

OTHER PUBLICATIONS

Office Action issued in corresponding Japanese Patent Application No. 2005-258308 dated Nov. 6, 2009.

* cited by examiner

*Primary Examiner* — Judy Nguyen
*Assistant Examiner* — Andy Pham
(74) *Attorney, Agent, or Firm* — Rossi, Kimms & McDowell LLP

(57) ABSTRACT

An image forming system executes image forming with pages kept continuous by controlling supplying of sheets corresponding to pages for which sheets have not fed in consideration of pages for which sheets have already been fed, even if image forming processing is temporally suspended.

7 Claims, 15 Drawing Sheets

IMAGE FORMING SYSTEM

BACKGROUND OF THE INVENTION

1. Field of the Invention

The present invention relates to an image forming technique. Specifically, the present invention relates to an image forming processing technique that keeps continuity of unsupplied pages and supplied pages, even if the image forming processing is temporally suspended.

2. Description of the Related Art

As a field relating to a digital copying machine or printing, a field called "on demand print" has been drawing attention. On demand print can meet demands for various types of products by small lot and can also make the print contents to be changed easily. That is suitable for producing a document such as a manual or the like or a pamphlet.

Further, substantial reduction of print inventory or substantial shortening of man-hour enabled by inline completion from data input to book binding can be realized. It is also characterized in that substantial shortening of delivery time or reduction of a delivery cost can be realized based on simplicity or the like in the data transfer provided by communication with a customer via a digital circuit.

In the on demand print technique, digital copying machines have been used for printing a catalog an instruction manual of a product, documents distributed in an office or the like, as their image quality has been improved to the level comparable to printed materials. An image forming system which uses a copying machine accommodating on demand printing has been composed of a plurality of large capacity recording medium feeding apparatuses sequentially connected to address various types of materials.

Further, there is an image forming system for performing various post-processes on a recording medium (hereinafter, merely called as a "sheet".) outputted from an image forming apparatus. For example, a Z-folding process (an A3 sized sheet is Z-folded into an A4 sized sheet.) or an inserter process to insert a sheet between sheets is known. A large image forming system that performs post-processing steps such as a staple process for bundling sheets, a perforation process for perforating a sheet or a book binding process in a series of job operation is proposed.

FIG. 11 is a diagram for exemplifying an image forming system in which an image forming apparatus 1100 and a plurality of sheet feeding apparatuses (1110*a-d*), which are sheet processing devices for supplying sheets to the image forming apparatus 1100, are connected (sequentially connected). In such an image forming system as in FIG. 11, a conveyer channel from each sheet feeding apparatus to the image forming apparatus generally has a shared configuration. In such a configuration, if image forming is performed on a pamphlet consisting of a plurality of pages by using a plurality of kinds of sheets, the sheet feeding apparatus is also changed as the sheets are changed. For example, there may be a case where a sheet feeding apparatus nearest to the image forming apparatus (in FIG. 11, 1110*a*) is changed to a sheet feeding apparatus remotest from the image forming apparatus (in FIG. 11, 1110*d*).

In this case, a conveyer channel between the image forming apparatus 1100 and the sheet feeding apparatus 1110*d* is longer. Accordingly, with a sheet feeding process is performed at a usual sheet feeding timing, a conveying interval (distance between sheets) is longer than the case where sheets are fed from the sheet feeding apparatus 1110*a*, which causes a problem of lowering productivity of the system.

As a technique to solve the problem, a technique to change a feed timing or the like in consideration of the number, connections and arrangement of sheet feeding apparatuses to be connected to the image forming apparatus 1100 is proposed. As a technique of increasing the speed of conveying sheets on a conveyer channel to shorten the distance between the sheets, or as a technique of advance feeding such that feeding starts first from the sheet feeding apparatus remotest from the image forming apparatus without regard to the page order, a technique of improving productivity by keeping the interval between sheets the same.

When the advance feeding is performed, sheets are fed from each sheet feeding apparatus without regard to the pager order; many sheets are conveyed on a conveyer channel between a sheet feeing apparatus and an image forming apparatus.

If sheets are supplied by advance feeding without regard to the page order and a print process in response to an input from a user temporally stops, the page order deviates from the correct page order, for example an ascending order or a descending order, resulting in an erroneous page order. In such a case, sheets ejected after the last sheet of those ejected in the correct page order need to be removed and a feeding process needs to start at a sheet corresponding to the next page when a print process resumes.

In Japanese Patent Publication No. 8-27559, a technique about temporal suspension and resuming in a double-sided printing apparatus is disclosed for stopping and resuming of a print process. As Japanese Patent Publication No. 8-27559 is for keeping a second image forming operation (sheet feeding) for a sheet on which a first image forming operation has started so as not to accumulate sheets in the apparatus to stop the apparatus when a double-sided image forming is temporally suspended.

The configuration of Japanese Patent Publication No. 8-27559, however, is not for suspension and resuming due to advance feeding, and does not disclose anything about sheet feeding for image forming of a new first side.

SUMMARY OF THE INVENTION

The present invention is adapted in view of the problem of suspension and resuming due to advance feeding. The present invention intends to provide an image forming technique for enabling image forming with pages kept continuous by controlling supplying of sheets corresponding to pages for which sheets have not fed in consideration of pages for which sheets have already been fed, even if image forming processing is temporally suspended due to the advance feeding.

Alternatively, the present invention intends to provide an image forming technique with productivity kept high without wasting any sheets by controlling supplying of sheets corresponding to unfed sheets in consideration of already fed pages to keep pages serial.

According to the present invention, the foregoing object is attained by providing an image forming system that is configured by an image forming apparatus and a plurality of recording medium feeding apparatuses are connected to the image forming apparatus, the image forming system comprising:

a control unit adapted to perform an image forming process while pre-feed is performed by synchronizing feeding timing of a recording medium fed from a first recording medium feeding apparatus with feeding timing of a recording medium fed from a second recording medium feeding apparatus, wherein, if a request to suspend the image forming process is issued during the recording medium is fed and conveyed, said control unit does not perform the pre-feed after the recording medium that has been fed, and continues to control the operation of the pre-feed on the recording medium that has been fed.

According to the present invention, image forming with pages kept serial is realized by controlling supplying of sheets corresponding to unfed pages in consideration of already fed pages, even if an image forming process is temporally suspended due to advance feeding.

Alternatively, image forming technique with productivity kept high can be provided without wasting any sheets by controlling supplying of sheets corresponding to unfed sheets in consideration of already fed pages to keep pages serial.

Further features of the present invention will become apparent from the following description of exemplary embodiments (with reference to the attached drawings).

BRIEF DESCRIPTION OF THE DRAWINGS

FIGS. 7A-1, 7A-2 are flowcharts for illustrating a flow of processes when a plurality of sheets are fed from sheet feeding apparatuses 1200*a*-1200*d;*

DESCRIPTION OF THE EMBODIMENTS

An embodiment of present invention will be described in detail with reference to the drawings.

(Configuration of Image Forming System)

Figure 1:
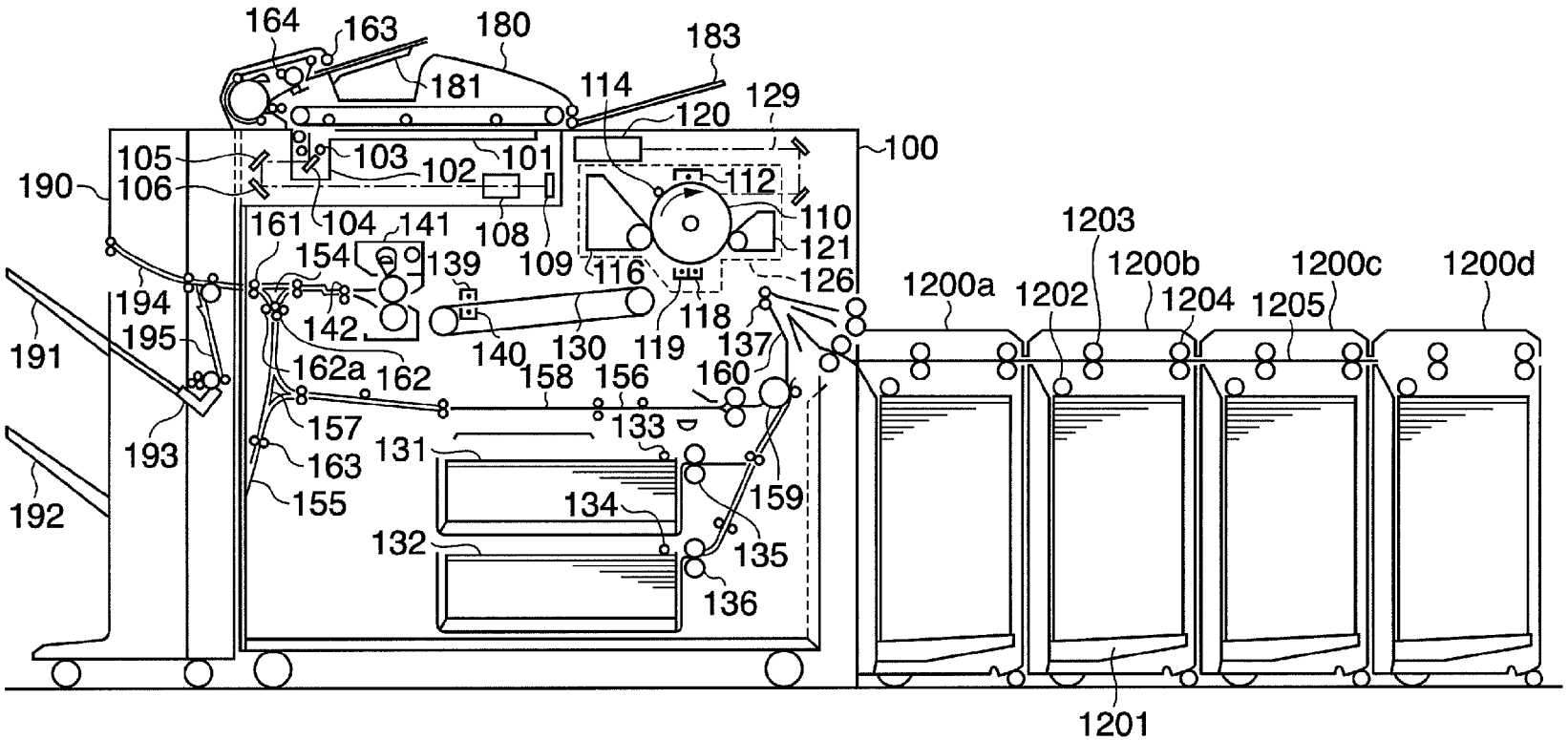
FIG. 1 is a diagram showing a configuration of an image forming apparatus and sheet feeding apparatuses according to an embodiment of the present invention.

FIG. 1 is a diagram showing a configuration of an image forming apparatus and sheet feeding apparatus (hereinafter referred to as "sheet feeding deck") according to an embodiment of the present invention. In FIG. 1, the reference numeral 100 designates the main body of an image forming apparatus, and 101 designates a platen glass as a master copy placing table. The reference numeral 102 designates a scanner, consisting of a master copy illumination lamp 103, a scanning mirror 104 and the like. A master copy image of a master copy placed on the platen glass 101 is scanned by a scanner 102 controlled by a motor (not shown) so as to reciprocate in a predetermined direction (horizontal direction on the figure). Then, a reflected light from the master copy is filtered through a lens 108 via scanning mirrors 104-106 and imaged on an image sensor unit (CCD sensor) 109 and converted into an electric signal.

The reference numeral 120 designates an exposure control unit consisting of a laser output unit, polygon scanner and the like, emitting a laser beam 129 on a photosensitive drum 110 of an image forming unit 126. The laser beam 129 is modulated based on an image signal resulted from predetermined image processing to be described later performed on an electric signal which is a reflected light of the master copy outputted from the image sensor unit 109 subject to photoelectric conversion.

A primary charging unit 112, a developing unit 121, a transfer charging unit 118, a separate charging unit 119, a cleaning device 116 and a pre-exposure lamp 114 are provided around the photosensitive drum 110 to form an image forming unit 126. The photosensitive drum 110 is controlled by a motor (not shown) to roll in the direction of the arrow shown in the figure. The photosensitive drum 110 is charged to a desired potential by the primary charge unit 112. Then, a laser beam 129 is radiated from the exposure control unit 120 and an electrostatic latent image is formed on a drum. The electrostatic latent image formed on the photosensitive drum 110 is developed by the developing unit 121 and made visual as a toner image.

On the other hand, the sheet which is fed by a pick up roller 133 or 134 from an upper stage cassette 131 or a lower stage cassette 132 is sent to the main body 100 by a sheet feeding roller 135 or 136, and passes through a sheet path 160, then fed into a conveyer belt 130 by a resist roller 137, and a toner image which is made visual on the photosensitive drum 110 is transferred by the transfer charging unit 118.

In the photosensitive drum 110 with the transferred image, remaining toner is cleaned by the cleaning device 116 and a remaining charge is deleted by the pre-exposure lamp 114.

A sheet with the transferred image is separated from the image forming unit 126 by the separate charging unit 119 and conveyed to left on the figure by a conveyer belt 130. The toner image on the sheet is charged again by pre-fix charging units 139 and 140 and fixed on the sheet as it is pressed and heated at a fixing unit 141. The fixed sheet is ejected outside the main body 100 by a discharging roller 142.

A plurality of large capacity sheet feeding decks 1200 are serially connected (1200*a* to 1200*d*) to the main body 100. For example, a lifter 1201 of the sheet feeding deck 1200*b* is adapted to go up according to the amount of sheets so that the sheet always touches the sheet feeding roller 1202.

It has a remaining amount detecting sensor for detecting the remaining amount of sheets (not shown). The sheet feeding decks 1200*a-d* have a conveyer path 1205 for sheets, and sends the sheets sent from upstream (from the right side in the figure) to downstream than the conveyer rollers 1203 and 1204. Therefore, in a system in which a plurality of sheet feeding decks are connected as in the embodiment, sheets picked up at the upstream deck are serially conveyed on the conveyer path 1205 of the downstream sheet feeding deck and finally fed in the main body of the image forming apparatus 100. Then, the conveyer path 1205 is adapted to be able to perform a conveying operation even if sheet feeding decks 1200*a-d* are kept open for supplying sheets. It is also adapted to be able to set information including the size of sheets, the type of sheet to be stored by a manipulation unit (not shown).

The reference numeral 154 designates a paper discharging flapper, which switches a sheet path at a disparaging side and a sheet path at a double-sided printing side or an overlay printing side. The sheet sent out from the ejection roller 142 is conveyed to the sheet path at the double-sided printing side or the overlay printing side when the paper discharging flapper 154 is taken upward. In the double-sided printing, a sheet with the first side fixed is sent out from the sheet discharging roller 142 and reversed by a reversing path 155 and led to a sheet re-feed tray 156 though a lower conveyer path 158. The reference numeral 157 designates an overlay flapper for switching a sheet path for double-sided printing and a sheet path for overlay printing. As the overlay flapper is taken down to the left, a sheet is directly led to the lower conveyer path 158 without passing through the reversing path 155, which enables overlay printing. The reference numeral 159 designates a sheet feeding roller for feeding a sheet to an image forming unit 126 side through the sheet path 160.

The reference numeral 161 designates an ejection roller placed near the paper discharging flapper 154. The discharging roller operates to discharge a sheet sent out from the discharging roller 142 outside the apparatus while the paper discharging flapper 154 is switched to the discharging side (while it is not taken upward). As mentioned above, at the double-sided printing or the overlay printing, the discharging flapper 154 is taken upward and a fixed sheet is passed through the lower conveyer path 158 and stored in the sheet re-feed tray 156.

The sheets stored in the sheet re-feed tray 156 are separated a sheet by a sheet from the bottom by the sheet feeding roller 159 and led to a resist roller 137 of the main body 100 via the sheet path 160 again.

When the sheet is reversed and discharged from the main body 100, the discharging flapper 154 is taken upward and the overlay flapper 157 is taken to the right. Then the sheet to be discharged is once sent to the reversing path 155 side, and conveyed to a second roller 162*a* side by a reversing roller 163 at timing when the backend of the sheet passes a first sending roller 162 and discharged from the apparatus by the discharging roller 161.

The reference numeral 180 is an automatic master copy conveyer apparatus (DF). Only a sheet on the surface of the master copies is separated by a sheet feeding roller 182 from a bundle of master copies placed on a master copy placing table 181, and conveyed on the platen glass 101 by a master copy feed roller 164. The master copy is then scanned by the scanner 102 and the scanned master copy is discharged to a master copy discharging table 183 or returned to the master copy placing table 181 again.

The reference numeral 190 is a sheet discharging processing device for aligning and sewing sheets discharged from the image forming apparatus 100 (bundle of discharged sheets). If a post-process operation on a bundle of discharged sheets such as a sorting or stapling (hereinafter referred to as a "discharged sheets post-process operation") is not set, the sheets pass through the conveyer channel 194 and discharged to the sheet discharging tray 191 without passing through the process tray 193. On the other hand, if bundle of discharged sheets post-process operation is set, the sheets discharged a sheet by a sheet through a conveyer channel 195 is stored in the process tray 193, and aligned. When sheets for image forming of a first volume has been discharged, the bundle of sheets is stapled and discharged to the sheet discharging tray 191 or the sheet discharging tray 192 by bundle.

If the discharged sheets post-process operation is set, the sheets are basically discharged by bundle to the sheet discharging tray 192. In some conditions such as the sheet discharging tray 192 being full, the discharged destination is controlled to be switched to the sheet discharging tray 191. The sheet discharging tray 191 or 192 is controlled to move up and down by a motor (not shown) so that a tray for storing discharged sheets is moved to a place of a process tray before the image forming operation starts.

Figure 2:
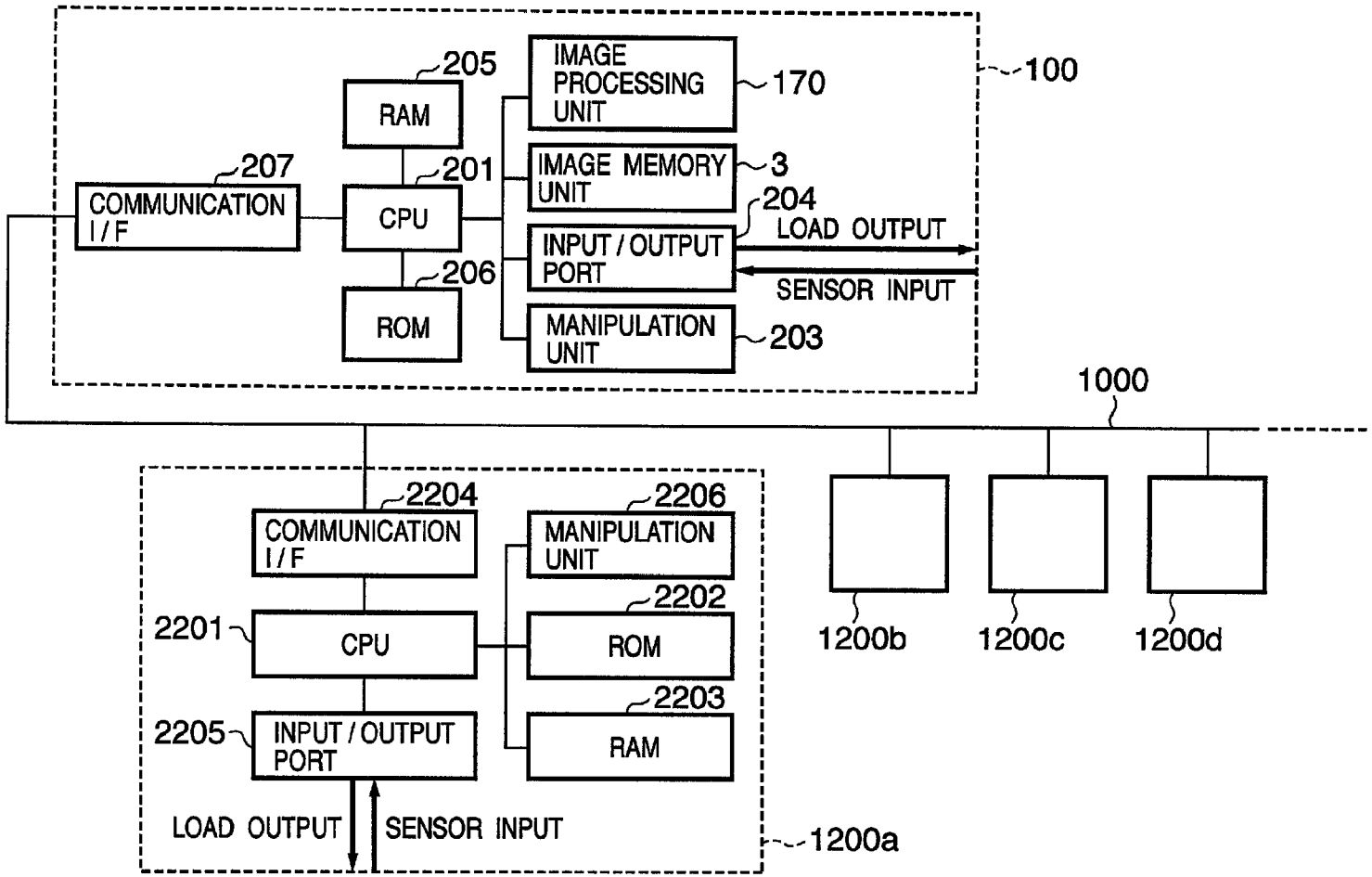
FIG. 2 is a block diagram showing a configuration of each of control units provided for the image forming apparatus and sheet feeding apparatus.

FIG. 2 is a block diagram showing a configuration of each of control units provided for the image forming apparatus 100 and sheet feeding deck 1200*a*. Here, the sheet feeding decks 1200*b*-1200*d* are assumed to have the same configuration as that of the sheet feeding deck 1200*a*.

The reference numeral 201 is a CPU for performing basic control of the image forming apparatus 100, with ROM 206 on which a control program is written, work RAM 205 for performing processes, and an input/output port 204 being connected with one another by an address bus and a data bus. A part region of the RAM 205 is backup RAM in which data is never deleted even if power is turned off. To the input/output port 204, various loading devices including a motor, a clutch and the like controlled by the image forming apparatus 100 or an input device for the image forming apparatus 100 including a sensor for detecting a place of a sheet are connected.

A CPU 201 can execute image forming processing by controlling input and output in order via the input/output port 204 according to the contents of a control program in the ROM 206.

The CPU 201 is connected with a manipulation unit 203, and can control a display unit and a key input unit of the manipulation unit 203. A user can instruct the CPU 201 to switch the image forming operation mode or the display via the key input unit. The CPU 201 displays an operation state of the image forming apparatus 100 and an operation mode set by key input on the display unit of the manipulation unit 203. Manipulation of the display unit and the key input unit of the manipulation unit 203 will be described in detail with reference to FIG. 6 later.

The CPU 201 is connected with an image processing unit 170 for processing a signal converted into an electric signal at the image sensor unit 109 (FIG. 1), and an image memory unit 3 for accumulating processed images.

The reference numeral 2201 designates a CPU for performing a basic control of the sheet feeding deck 1200*a*. To the CPU 2201, ROM 2202, to which a control program is written, work RAM 2203 for performing a process, and an input/output port 2205 are connected by address buses and data buses. A part region of the RAM 2203 is a backup RAM in which data is never deleted even if power is turned off. To the input/output ports 2205, various loading devices including a motor, a clutch and the like controlled by the sheet feeding decks 1200 or an input device for the sheet feeding decks 1200 including a sensor and the like for detecting a place of a sheet are connected.

The CPU 2201 is connected with a manipulation unit 2206, and can control a display unit and a key input unit of the manipulation unit 2206. A user can instruct the CPU 2301 to set an operation of the sheet feeding deck 1200, the type of sheet, the size of sheet and the like through the key input unit. The CPU 2201 can display an operation state of the sheet feeding deck 1200, the type of sheet or the size of sheet set by key input on the display unit of the manipulation unit 2206.

The CPU 2201 can control separation and conveyance processes of a sheet corresponding to a command from the image forming apparatus 100 by serially controlling input and output via the input/output port 2205 according to the contents of a control program of the ROM 2202. Devices (100, 1200*a*) are connected with each other via a communication IFs 2204, 207 and a network 1000, and can communicate with each other of information included in respective devices.

In the image forming system having the image forming apparatus 100 and the sheet feeding decks (1200*a-d*) for supplying sheet for the image forming apparatus, control units (CPU 201, CPU 2201) for controlling the image forming apparatus and the sheet feeding deck realizes functions below.

The control units (CPU 201, CPU 2201) determine whether sheets supplied from the sheet feeding apparatus has been fed or in a waiting state for the sheets to be supplied to cause the image forming apparatus to execute the image forming processing based on inputted information.

The control units (CPU 201, CPU 2201) control conveyance of already fed sheets or sheets in a waiting state, according to a request to suspend the inputted image forming processing.

Figures 1, 7A:
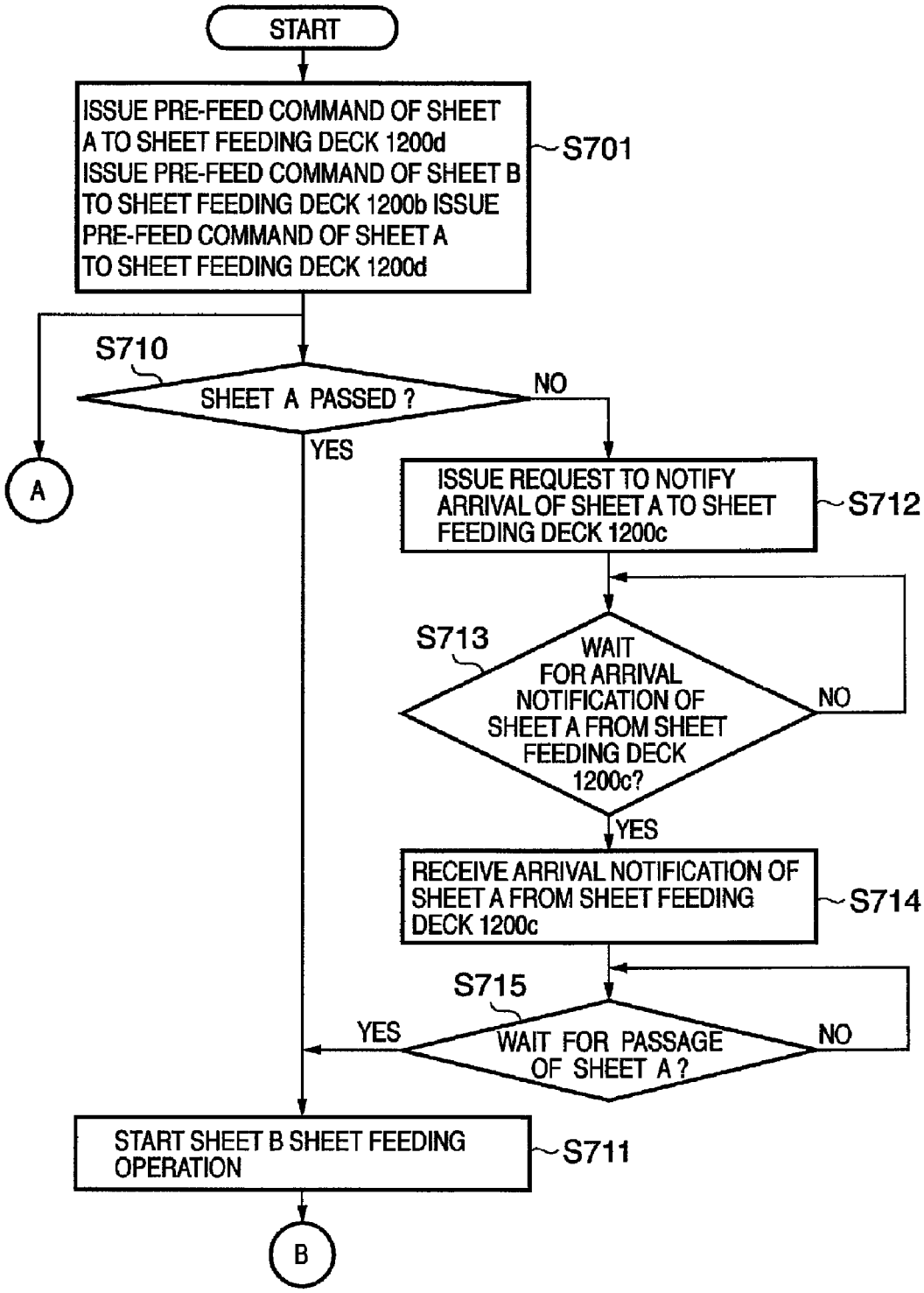
Figures 2, 7A:
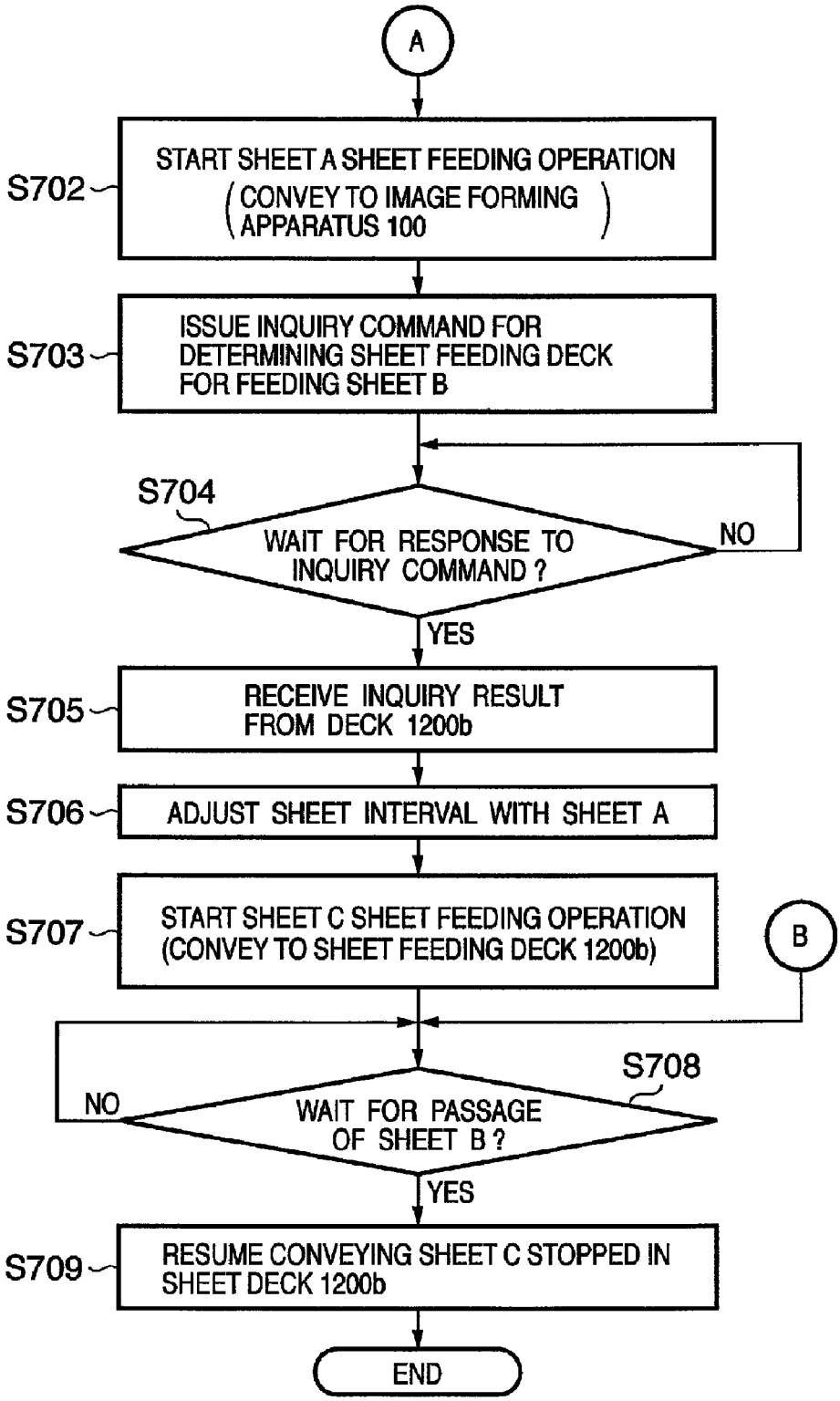
Figure 10:
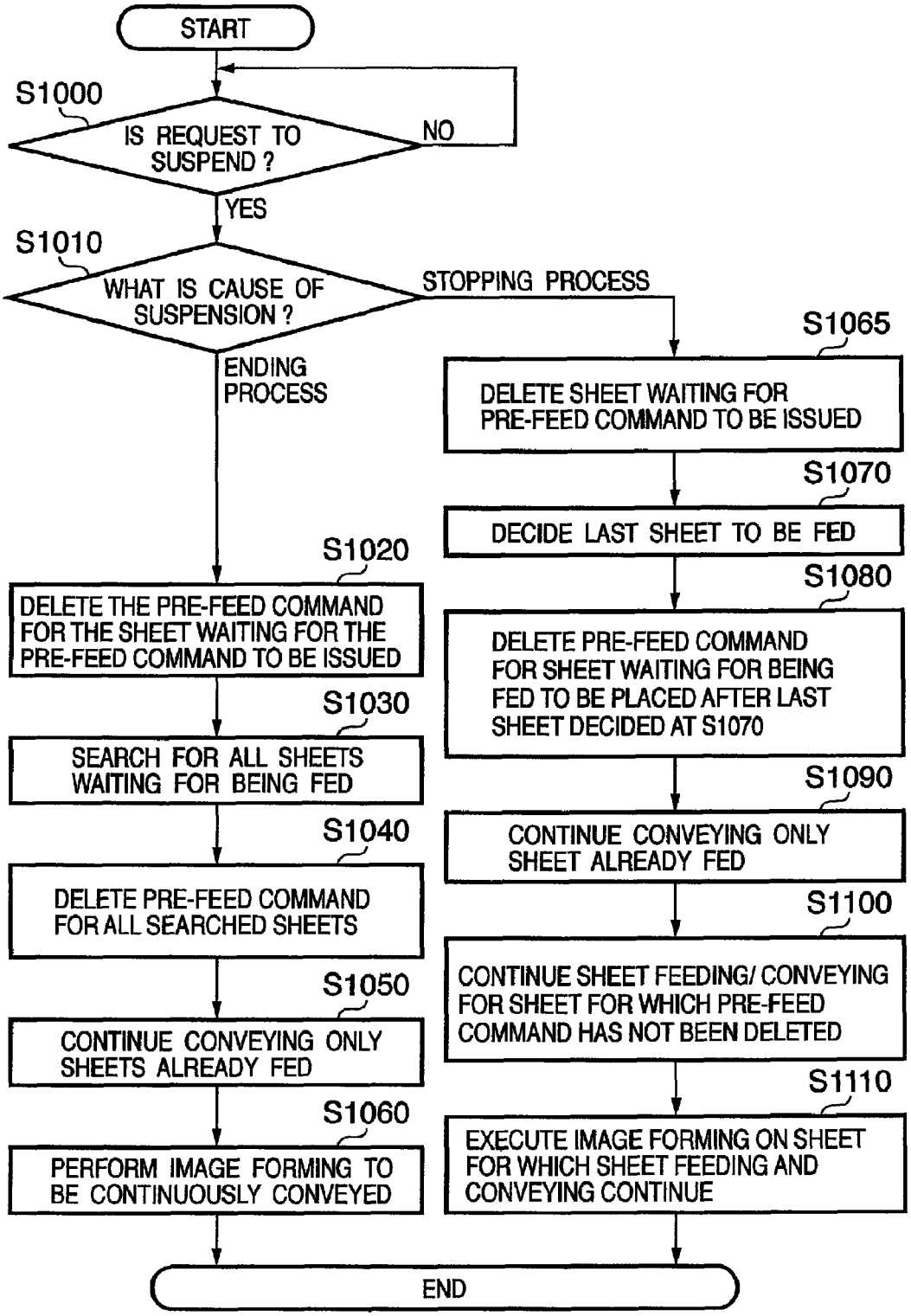
FIG. 10 is a flowchart for illustrating a flow of processes of an image forming apparatus according to suspending factor.
Figure 11:
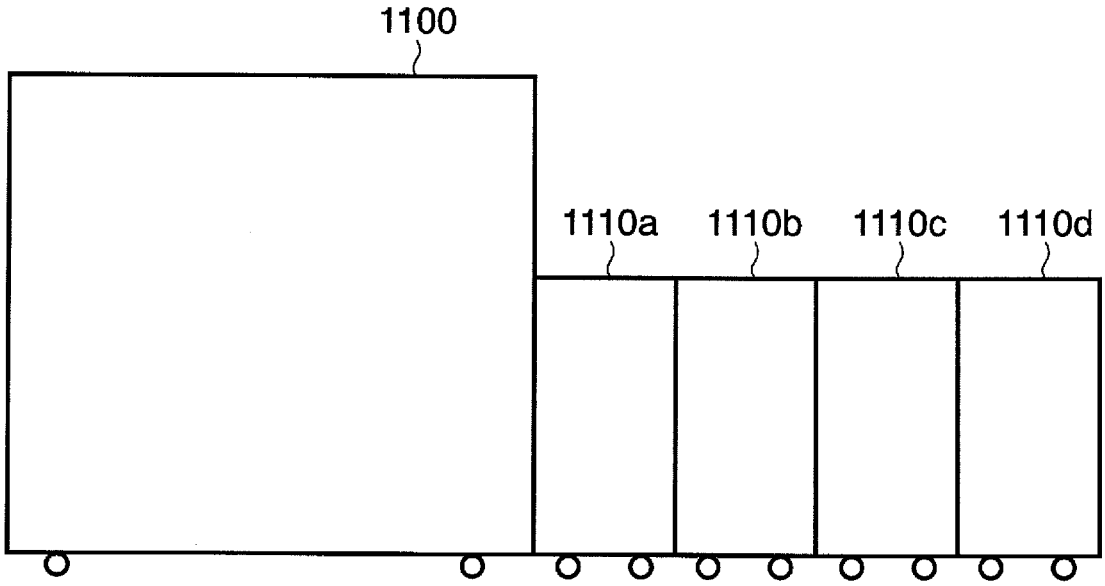
FIG. 11 is a diagram for illustrating an image forming system of a conventional art.

Specific processes based on the abovementioned functions will be specifically described in FIG. 7A-1 to FIG. 10 to be described later.

Next, an image processing unit 170 and an image memory unit 3 will be described with reference to FIGS. 3 and 4, respectively.

Figure 3:
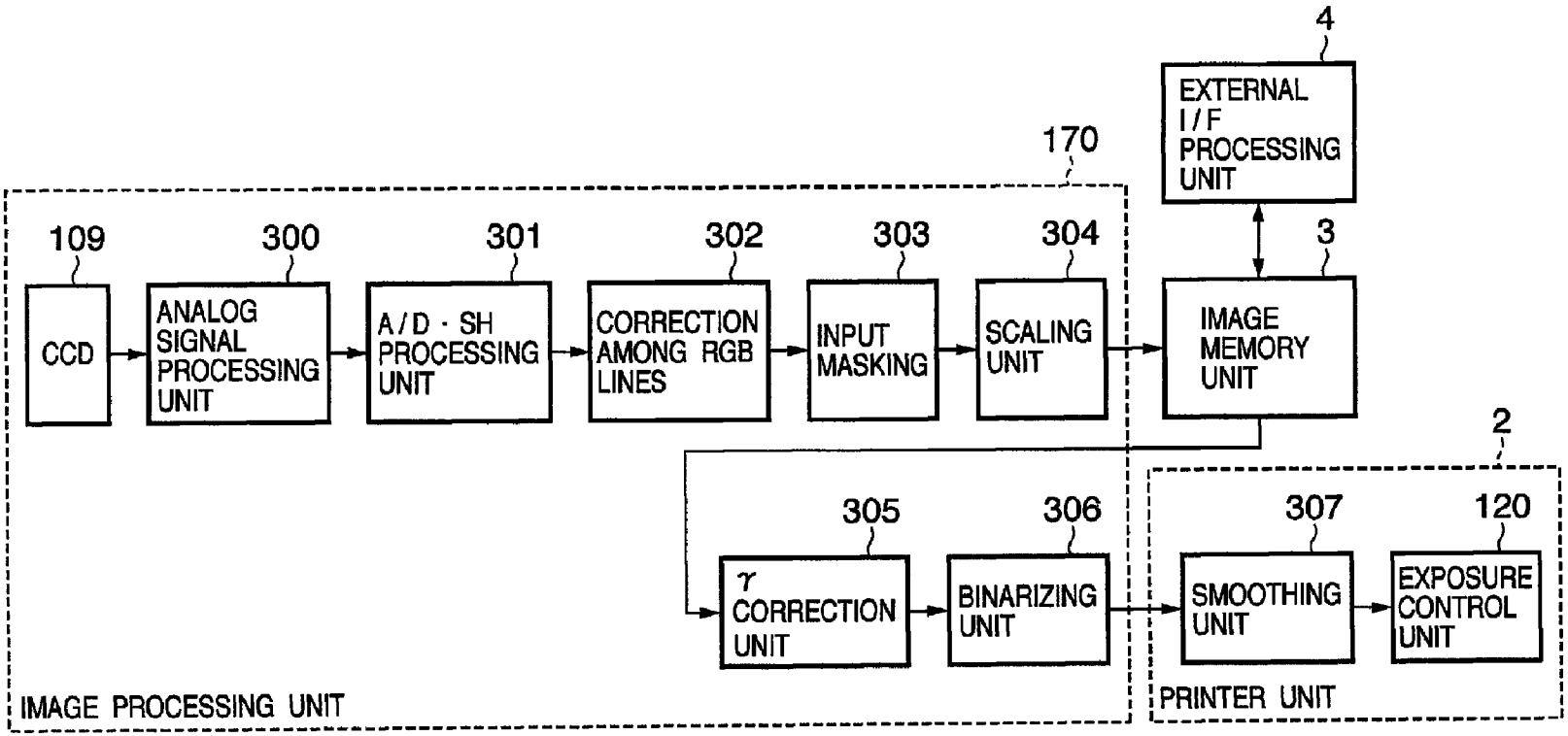
FIG. 3 is a block diagram showing an inside configuration of an image processing unit and devices connected to an image memory unit 3.

FIG. 3 is a block diagram showing an inside configuration of an image processing unit 170 and devices connected to the image memory unit 3.

First, a flow of processes when a scanned image is printed will be described. A master copy image imaged on the image sensor unit 109 via the lens 108 is converted into an analog electric signal by the image sensor unit 109. The converted image information is inputted into an analog signal processing unit 300 and subject to sample & hold, dark level correction or the like, then, subject to analog/digital conversion (A/D conversion) at an A/D·SH processing unit 301. Further, shading correction is performed on the digitalized signal. In the shading correction, correction on variation for each pixel included in the image sensor unit 109, or correction on variation in amount of light depending on a place based on deflecting characteristics of the master copy illumination lamp 103 is performed.

Thereafter, correction among RGB lines is performed in the correction among RGB lines unit 302. As a light inputted into each photoreceptor of RGB of the image sensor unit 109 at some moment is shifted according to positional relationship of respective photoreceptors of RGB on the master copy, synchronization is taken among the RGB signals.

Thereafter, an input masking process is performed at an input masking unit 303, and brightness data is converted to density data. As the RGB values as outputted from the image sensor unit 109 are influenced by a color filter attached to the image sensor unit 109, the influence is corrected and converted into pure RGB values.

Thereafter, an image is scaled by a desired scaling rate at a scaling unit 304 and the scaled image data is sent to the image memory unit 3 and accumulated there.

To the image memory unit 3, image data from a computer is inputted from the external I/F processing unit 4.

When the accumulated image is printed, first, the image data is sent to an image memory unit 3 to gamma correction unit 305. At the gamma correction unit 305, the original density data is converted into density data corresponding to a desired output density based on a look-up table (LUT) in consideration of characteristics of a printer to make the output according to a density value set at the manipulation unit 203.

Thereafter, the density data is sent to a binarizing unit 306. At the binarizing unit 306, multi-valued density data is binarized. If it is a multi-valued density data such as eight-bit density data, the density value takes any value from "0" to "255". By binarizing, the density value is only two of "0" and "255", for example. That is to say, as data is binarized, the amount of data of only one bit is enough, while eight bit of data is needed to represent a density of a pixel. That reduces a capacity of memory for storing image data.

On the other hand, as gradation of the image changes from the original 256 gradations to 2 gradations, in such image data with many half tones such as a photograph image, the image quality is usually remarkably degraded due to binarization of an image.

Then, pseudo halftone representation by binarized data becomes important. Here, an error diffusing method is used as a technique for performing halftone representation in a pseudo manner on binarized data. In this method, first, if density of an image is larger than a threshold, it is considered as density data of "255" and, if it is the threshold or under, it is considered as density data of "0" and binarized. Then, a difference between an actual density data and a binarized density data is obtained as an error signal, and distributed to pixels around. Distribution of the errors is performed as a weighting factor on a predetermined matrix is multiplied with an error caused by the binarization and added to pixels around. That saves an average value of density for an entire image and enables halftone to be represented by binary value in pseudo manner.

The binarized density data is sent to a smoothing unit 307 in the printer unit 2. At the smoothing unit 307, data complementation is performed so that an edge of a line of the binarized image is smooth. The complemented image data is outputted to the exposure control unit 120. The exposure control unit 120 forms the electrostatic latent image of image data on the photosensitive drum 110 as mentioned above.

Next, a flow of processes of transferring the scanned image over a network will be described. The processes until density data is accumulated in the first half of the image memory unit 3 are the same as the abovementioned processes at printing. Thereafter, image data is sent from the image memory unit 3 to the external I/F processing unit 4 and transferred to a desired computer over a network 1000 from the external I/F processing unit 4.

Figure 4:
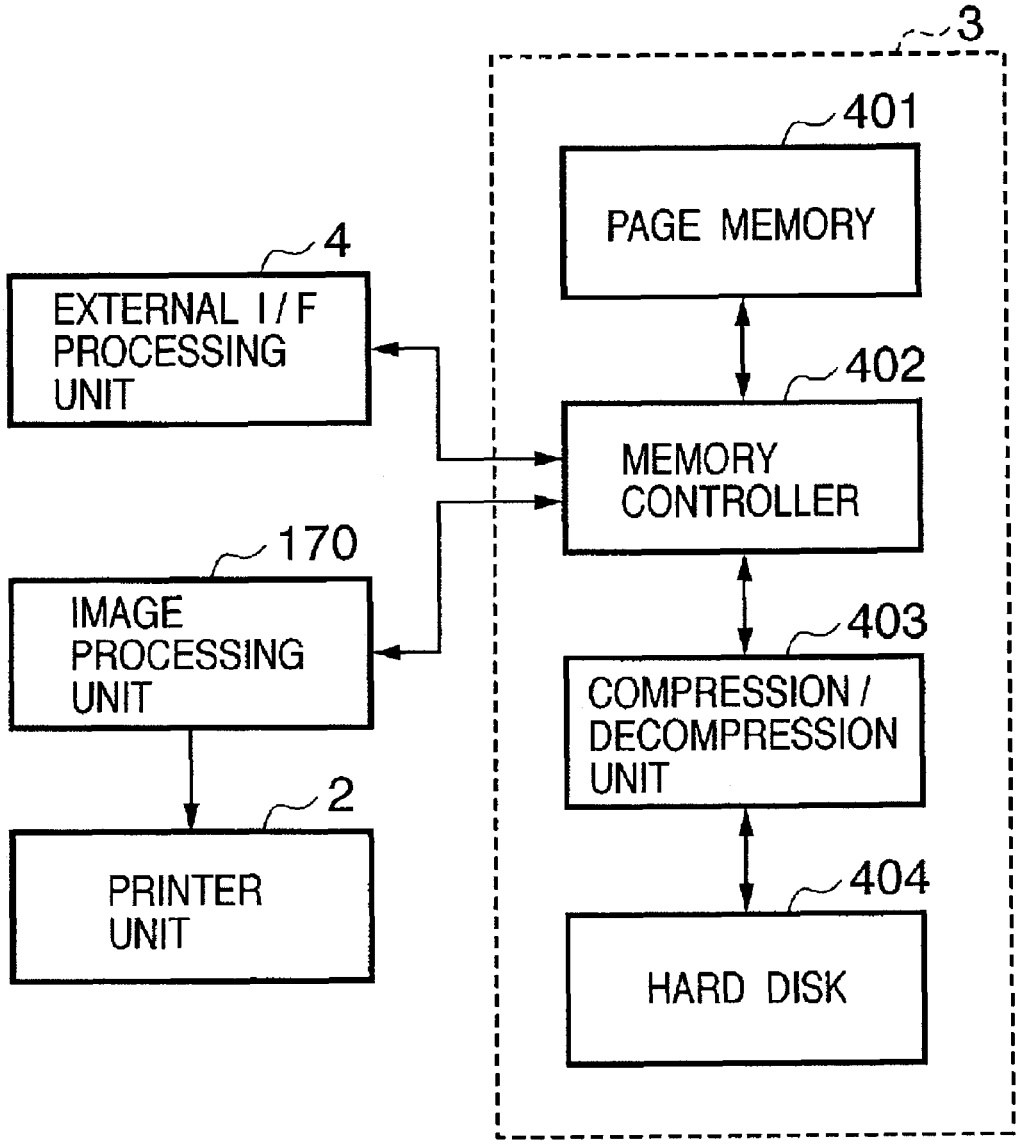
FIG. 4 is a block diagram showing an inside configuration of the image memory unit 3 and peripheral devices.

FIG. 4 is a block diagram showing an inside configuration of the image memory unit 3 and peripheral devices. The image memory unit 3 consists of a page memory 401, a memory controller 402, a compression/decompression unit 403, and a hard disk 404.

The image data sent from the external I/F processing unit 4 and the image processing unit 170 to the image memory unit 3 is written into a page memory 401 by the memory controller 402. Then, it is sent to a printer unit 2 via an image processing unit 170 or accumulated in the hard disk 404.

When image data is accumulated in the hard disk 404, the image data is subject to data-compression at the compression/decompression unit 403 and written into the hard disk 404 as compressed data. The memory controller 402 can also read out image data stored in the hard disk 404 to the page memory 401. At the moment, the compressed data read out from the hard disk 404 is decompressed via the compression/decompression unit 403 and the restored image data is written into the page memory 401. The memory controller 402 can also generate a DRAM refresh signal to be sent to the page memory 401.

The memory controller 402 performs arbitration of accessing the page memory 401 from the external I/F processing unit 4, the image processing unit 170, and the hard disk 404. Further, it performs decision control of a writing-address to the page memory 401, a reading address to the page memory 401, and the reading direction according to an instruction of the CPU 201.

With abovementioned processes, the CPU 201 can control a function of arranging a plurality of master copy images and laying out in the page memory 401 and then outputting them via the image processing unit 170 to the printer unit 2, a function of cutting out a part of an image and outputting it, and a function of rotating an image. For example, a sort mode can be realized as control of reading out and printing images in an order recorded in the image memory unit 3 is repeated by a plurality of times for a bundle of master copies. With such a control, even a finisher with a small number of bins can play the same roll as a sorter with many bins, as the sheet discharge processing device 190 in the image forming apparatus according to the embodiment does.

Figure 5:
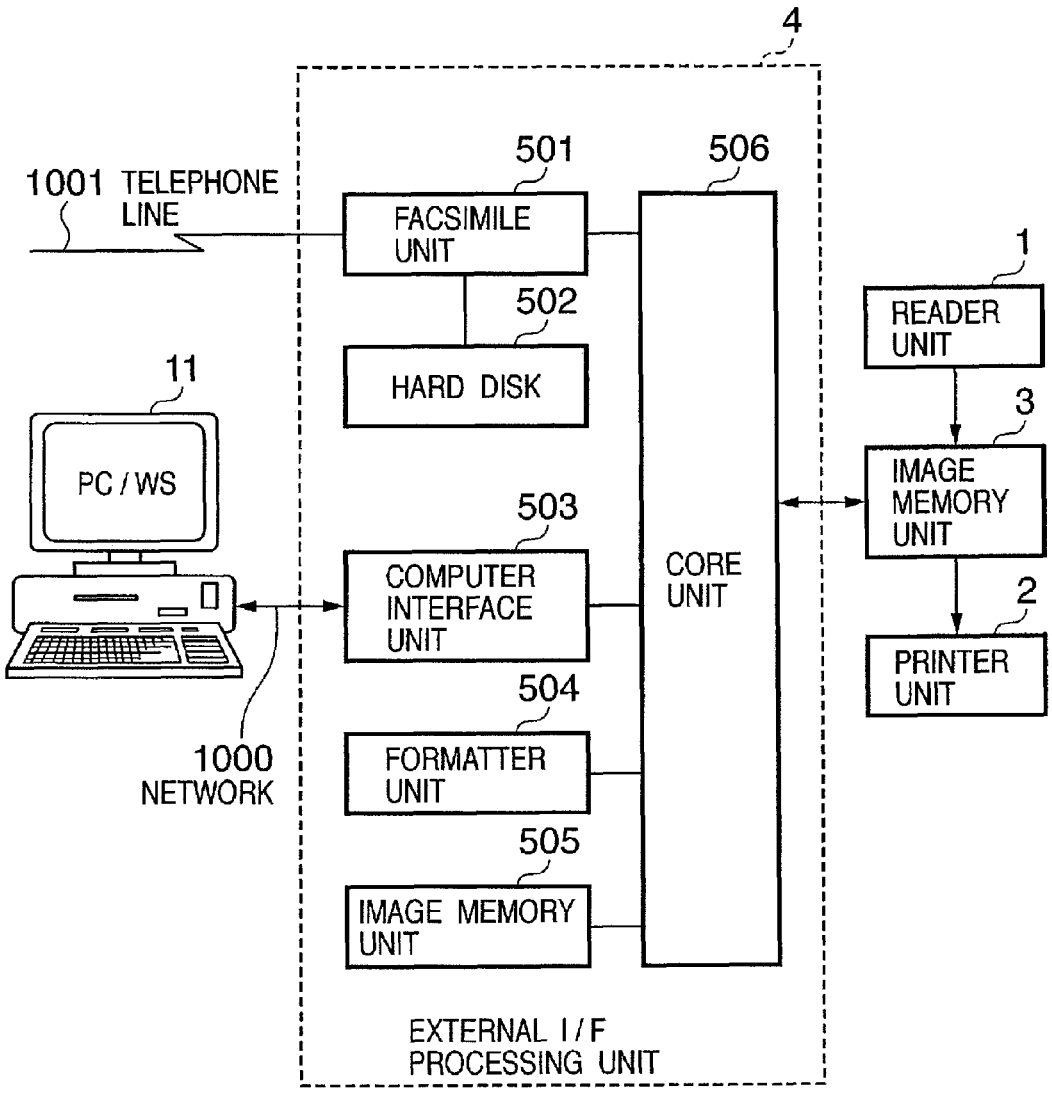
FIG. 5 is a block diagram showing an inside configuration of the external I/F processing unit 4 and peripheral devices.

FIG. 5 is a block diagram showing an inside configuration of the external I/F processing unit 4 and peripheral devices. The external I/F processing unit 4 can retrieve image data from a reader unit 1 via an image memory unit 3, and can send image data to an external computer or an external facsimile via a network 1000 or a telephone line 1001. The external unit I/F processing unit 4 can also output image data sent from an external computer or a facsimile via a network or a telephone line to the printer unit 2 via the image memory unit 3 and the image processing unit 170.

The external I/F processing unit 4 consists of a core unit 506, a facsimile unit 501, a hard disk 502 for saving communication image data, a computer interface unit 503 connecting with an external computer 11, a formatter unit 504 and an image memory unit 505.

The facsimile unit 501 is connecting to the telephone line 1001 via a modem (not shown) and receives facsimile communication data from the telephone line 1001 and sends facsimile communication data to the telephone line 1001. The facsimile unit 501 realizes a facsimile function such as sending a facsimile at a designated time or sending image data in response to inquiry by a designated password from the other party by using an image for facsimile saved in the hard disk 502. That enables an image to be once sent from the reader unit 1 to the facsimile unit 501 via the image memory unit 3, and save the image in the hard disk 502 for facsimile, then, facsimile to be sent without using the reader unit 1 and the image memory unit 3 as a facsimile function.

The computer interface unit 503 is an interface unit for performing data communication with the external computer 11. The computer interface unit 503 has a local area network (LAN), a serial I/F, an SCSI-I/F, Centronics I/F for inputting data into printer. States of the printer unit 2 and the reader unit 1 can be notified to an external computer 11 via the computer interface unit 503. Alternatively, an image read out by the reader unit 1 can be transferred to the external computer 11 in response to an instruction from the external computer 11.

The computer interface unit 503 can also receive print image data from the external computer 11. At the moment, as the print image data notified from the external computer 11 is written by dedicated printer codes, a formatter unit 504 converts the notified data codes into raster image data which can be subject to image forming at the printer unit 2. The converted raster image data is loaded in the image memory unit 505 by the formatter unit 504.

On the other hand, when the formatter unit sends image data to an external computer via 503, it performs density conversion and conversion into an image format which can be recognized by an external computer on the print image data sent from the image memory unit at the image memory unit.

The image memory unit 505 is used as a memory where raster image data of the formatter unit 504 is loaded and also used when image data from the reader unit 1 is sent to the external computer 11 (a network scanner function).

That is to say, when an image inputted from the reader unit 1 is sent to the external computer 11 over the computer interface unit 503, image data sent from the image memory unit 3 is once loaded in the image memory unit 505. Then, the data is converted into a format of data to be sent to the external computer 11 by the formatter unit 504, the computer interface unit 503 sends out data converted into a predetermined data format to the external computer 11.

The core unit 506 controls and manages each data transfer performed among a facsimile unit 501, a computer interface unit 503, a formatter unit 504, an image memory unit 505 and an image memory unit 3. That enables exclusive control and priority control under the management of the core unit 506, even if a plurality of image output units are connected to the external I/F processing unit 4 or an image transfer channel to the image memory unit 3 is one. That enables the image output to be executed appropriately.

Figure 6:
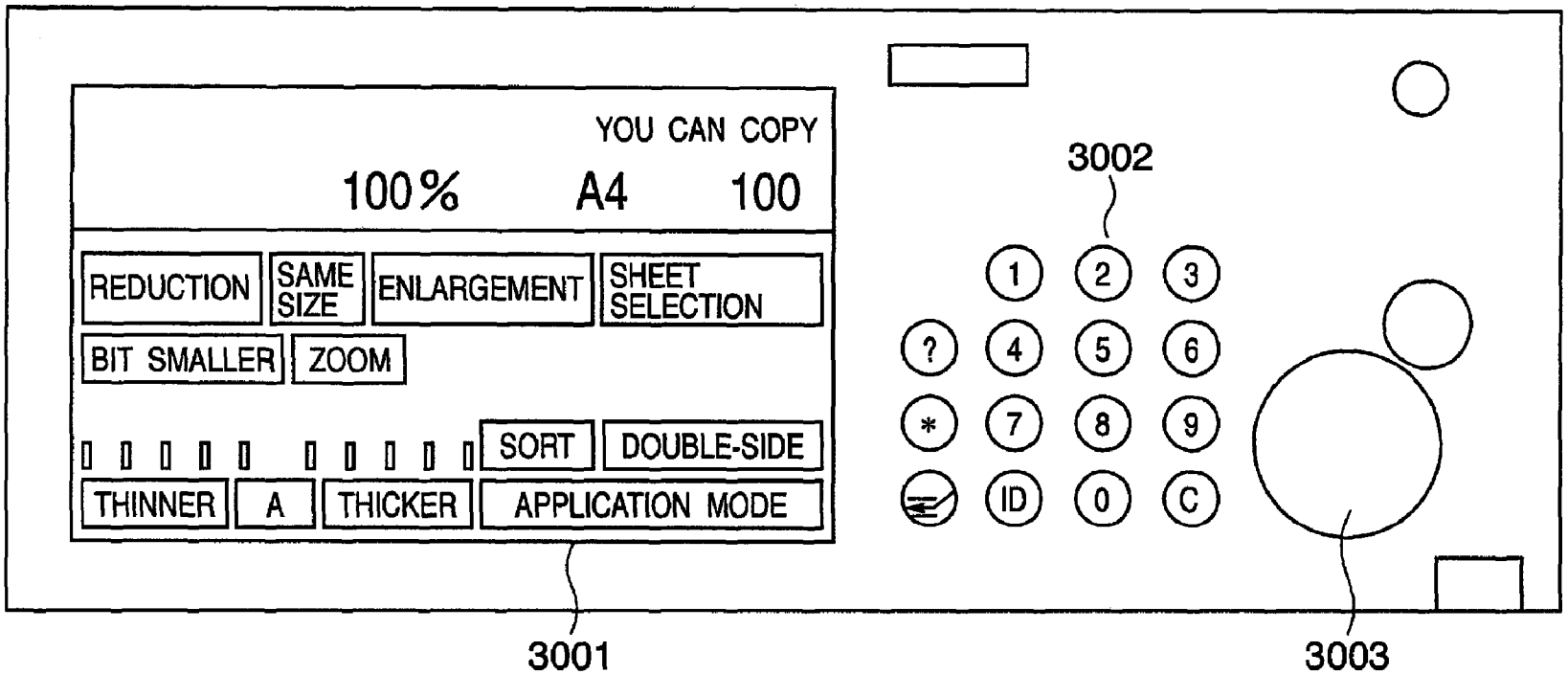
FIG. 6 is an outlined diagram showing a configuration of the manipulation unit 203 of the image forming apparatus.

FIG. 6 is an outlined diagram showing a configuration of the manipulation unit 203 of the image forming apparatus. In the figure, the reference numeral 3001 designates a display unit (display unit), on which various messages such as an operation state of an apparatus or an operation instruction to a user, operation procedures and the like are displayed. The surface of the display unit 3001 consists of a touch panel, and functions as a selection key as it is touched on the surface. The reference numeral 3002 is a ten key and a key for a user to input numbers. The selection key and the ten key 3002 of a touch panel displayed on the display unit 3001 function as a key inputting unit described in FIG. 2.

The reference numeral 3003 is a start key and starts a copying operation as it is pressed.

(Pre-Feed)

Next, pre-feed of sheets supplied from the sheet feeding deck 1200*b* will be described with reference to FIG. 1. The pre-feed of sheets is for temporally making sheets waiting on the conveyer path so as to synchronize it with sheet feeding timing of sheets fed from another sheet feeding deck (for example, 1200*a*). An operation on a mechanism for picking up a sheet from a sheet feeding deck and leading the sheet on a conveyer path is the same as the case of pre-feed or the case of sheet feeding for conveying a sheet until it is held tight by the resist roller 137 of the image forming apparatus 100.

The top sheet loaded in the sheet feeding deck 1200*b* is picked up by the sheet feeding roller 1202, while the roller is preventing the sheet from being sent with another sheet, and led onto a conveyer path by the conveyer roller (not shown) in the deck 1200*b*.

When a sheet is fed, a sheet is kept conveyed until it is held tight by the resist roller 137 in the image forming apparatus 100. On the other hand, in pre-feed as described above, a sheet is conveyed to a point where downstream sheet (viewing from the sheet feeding deck 1200*b*, a sheet supplied by the sheet feeding deck 1200*a*) converges, and then enters into a waiting state. The sheet supplied from the sheet feeding deck 1200*b* is conveyed until the tip of the sheet is detected by a sensor (not shown) placed immediately before the point converging with a conveyer path from the sheet feeding deck 1200*a* and, when it is detected, it temporally enters into a waiting state at the place.

Then after the sheet is converged from another conveyer path of the converging point, the waiting state is released and the sheet is kept conveyed until it is held tight by the resist roller 137 in the image forming apparatus by the conveyer roller in the sheet feeding deck 1200*a*.

If a sheet feeding command is outputted from the image forming apparatus 100 to each of the sheet feeding decks 1200*a*-1200*d*, each sheet is conveyed to a halfway point on the conveyer path and enters into a waiting state by pre-feed. Therefore, if the image forming apparatus 100 performs serial printing by using the sheet feeding decks 1200*a*-1200*d*, it can shorten a time required for conveying a sheet to be fed from each sheet feeding deck.

(Generation of Pre-Feed Command)

Figure 7B:
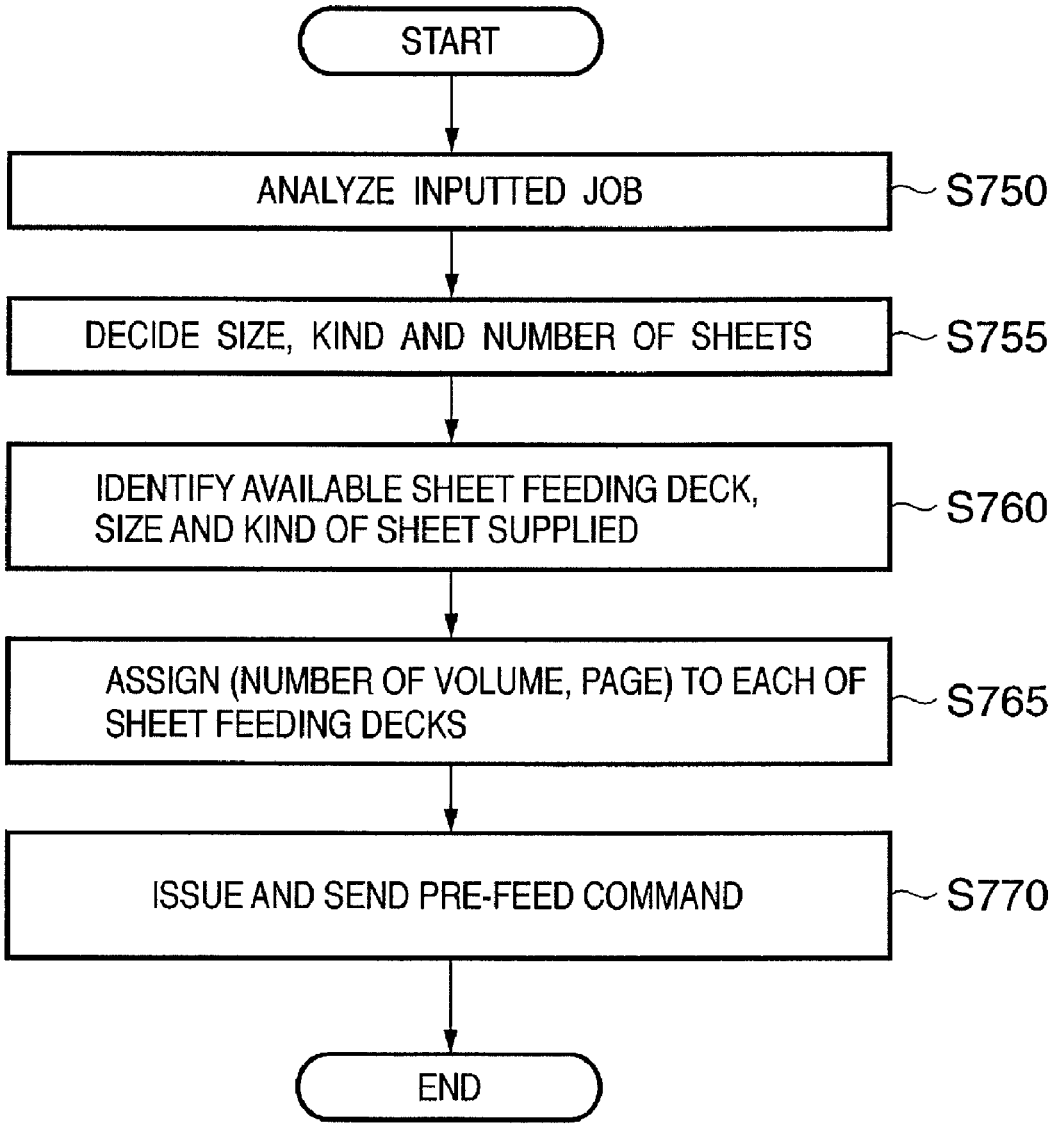
FIG. 7B is a flowchart for illustrating a flow of a generating process of a pre-feed command.

FIG. 7B is a flowchart for illustrating a flow of generating process of a pre-feed command. It is executed as it is controlled over by the CPU 201 in the image forming apparatus 100.

First, at the step S750, an inputted job is analyzed. For example, data which is a document placed on the platen glass 101 read in, or data which is read in via the DF 180 is processed as a print job.

At the step S755, the size, the kind and the number of sheets are decided.

At the step S760, the image forming apparatus 100 communicates with each of the sheet feeding decks connected thereto via the network 1000, and obtains information on the size and the kind of sheet supplied from each of the sheet feeding decks. Based on the information obtained by the image forming apparatus 100, an available sheet feeding deck, the size and kind of sheet supplied from each of the sheet feeding decks are identified.

At the step S765, a sheet feeding deck is assigned from the size and kind of sheet identified at the previous step S760 to execute an inputted job. For example, plain paper is allocated from the sheet feeding deck 1200*b* and a cardboard is allocated so as to be supplied from the sheet feeding deck 1200*d*.

At the step S770, the image forming apparatus 100 issues a pre-feed command including information on the required number of volumes and the page order as information for being supplied with sheets form each of sheet feeding decks, sends the command to an objective sheet feeding deck and ends the process.

(Recording Medium Feeding Process)

Next, a flow of processes where a plurality of sheets are fed from the sheet feeding decks 1200*a*-1200*d* will be described with reference to the flowcharts of FIGS. 7A-1 and 7A-2. Processes of each device in FIGS. 7A-1 and 7A-2 are assumed to be executed under control of the CPU 201, the CPU 2201 or the like.

Here, as a specific example of sheet feeding, an example of feeding sheets from each of the sheet feeding decks in the order shown in the table 1 will be described.

TABLE 1

| page order | sheet identifier | sheet feeding deck |
|---|---|---|
| 1 | sheet A | 1200d |
| 2 | sheet B | 1200b |
| 3 | sheet C | 1200d |

First, at the step S701, the image forming apparatus 100 issues pre-feed commands for the sheet A, the sheet B and the sheet C for the sheet feeding decks 1200*b* and 1200*d* in the page order shown in the table 1.

When each of the sheet feeding decks receives the pre-feed command from the image forming apparatus 100, it determines the presence of a sheet that should be fed from another sheet feeding deck and whether the sheet is fed according to the page order or not before conveying control of the sheet is executed.

At the step S702, the sheet feeding deck 1200*d* received the pre-feed command of the first sheet A (page order 1) immediately starts control conveying of the sheet A under the control of a CPU.

On the other hand, when the sheet feeding deck 1200*b* receives a pre-feed command of the sheet b (page order) 2, a CPU of the sheet feeding deck b determines whether the sheet A (page order 1) which should be placed before the sheet B has passed through the sheet feeding deck 1200*b* or not (S710).

At the step S710, if "the sheet A has not passed" (S710—No), a command for issuing a request to notify arrival of the sheet A is sent to the sheet feeding deck 1200*c* placed upstream from the sheet feeding deck 1200*b* (S712).

At the step S713, arrival notification of the sheet A from the sheet feeding deck 1200*c* is waited for. If no arrival notification on the sheet A is present (S713—NO), it enters into a waiting state of waiting for arrival.

On the other hand, if the sheet feeding deck 1200*b* receives the arrival notification of the sheet A (S713—YES, S714), the sheet feeding deck 1200*b* waits for the sheet A to pass through the sheet feeding deck 1200*b* (S715). At the step S715, if passage of the sheet A is detected (S715—YES), the process proceeds to the step S711, the sheet feeding deck 1200*b* starts an sheet feeding operation of the sheet B following to that of the sheet A under the control of a CPU.

On the other hand, at the step S710, if it is determined as "the sheet A has been passed" (S710—YES), the process proceeds to the step S711 and the sheet feeding deck 1200*b* starts control conveying of the sheet B (S711).

Next, the sheet feeding deck 1200*d* that received a pre-feed command of the sheet C (page order 3) inquires to determine the sheet feeding deck from which the sheet B to come before the sheet C is converged from (S703).

That is to say, the sheet feeding deck 1200*d* issues an inquiry command for determining the sheet feeding deck for feeding the sheet B to the sheet feeding decks 1200*a*, 1200*b* and 1200*c* placed downstream, and performs an inquiry.

At the step S704, the sheet feeding deck 1200*d* waits in a state of waiting for a response to the inquiry command.

If a response to the inquiry command is received (S704—YES), the process proceeds to the step S705 and the sheet feeding deck 1200*d* recognizes that the sheet feeding deck 1200*b* feeds the sheet B according to the response result.

Then, at the step S706, the sheet feeding deck 1200*d* adjusts and controls an interval between sheets so that an interval (interval between sheets) between the sheet A (pager order 1) which is previously fed and the sheet C (page order 3) to be fed next becomes a certain interval.

Then, after controlling a sheet interval with the sheet A, at the step S707, the sheet feeding deck 1200*d* starts a feed operation of the sheet C. The sheet C is conveyed to immediately before the converging point with the conveyer path of the sheet feeding deck 1200*b* (place of conveyer roller 1203 in FIG. 1) and enters into a waiting state.

At the step S708, passage determination of the sheet B is performed. That is to say, at the step S711, whether the sheet B for which a feeding operation starts has passed the conveyer path of the sheet feeding deck 1200*b* or not is determined. At the determination of the step S708, if the sheet B has not passed (S708—NO), the sheet C enters into a waiting state. On the other hand, if it is determined that the sheet B has passed (S708—YES), conveyance of the sheet C in a waiting state resumes, the sheet C is supplied to the image forming apparatus 100 and the process ends.

With the abovementioned conveyance control, the sheets A, B, and C supplied from the sheet feeding decks 1200*d*, 1200*b* are supplied to the image forming apparatus 100 in the correct page order (1, 2, 3).

(Suspension Process)

Next, a suspension process of feeding and conveying of sheets supplied from the sheet feeding decks 1200*a*-1200*d* to the image forming apparatus 100 will be described with reference to the FIGS. 8A and 8B, FIGS. 9A and 9B.

Here, a case of a printing operation is suspended in halfway of feeding and conveying in a case where necessary numbers of sheets are fed from each sheet feeding deck and conveyed for ten volumes of a document consisting of three pages as shown in the table 2, i.e. thirty sheets in all, will be described.

It is assumed that a pre-feed command to be issued from the image forming apparatus 100 to each of the sheet feeding decks 1200*a-d* corresponds to feeding of sheets by the maximum of 12 pages for simplicity of the example of suspension of feeding and conveying (that is also referred to as the "maximum pre-feed command"). It is a matter of course that the maximum pre-feed command (12 pages) does not indicate the limit value of the throughput capacity of the image forming apparatus and the sheet feeding deck according to the embodiment and can be arbitrarily set.

Processes in each device in FIGS. 8A and 8B, FIGS. 9A and 9B are assumed to be executed as being controlled over by the CPU 201 and the CPU 2201.

TABLE 2

| page order | sheet feeding deck to be fed | kind of sheet |
|---|---|---|
| 1 | 1200b | plain paper |
| 2 | 1200b | plain paper |
| 3 | 1200d | cardboard |

Figure 8A:
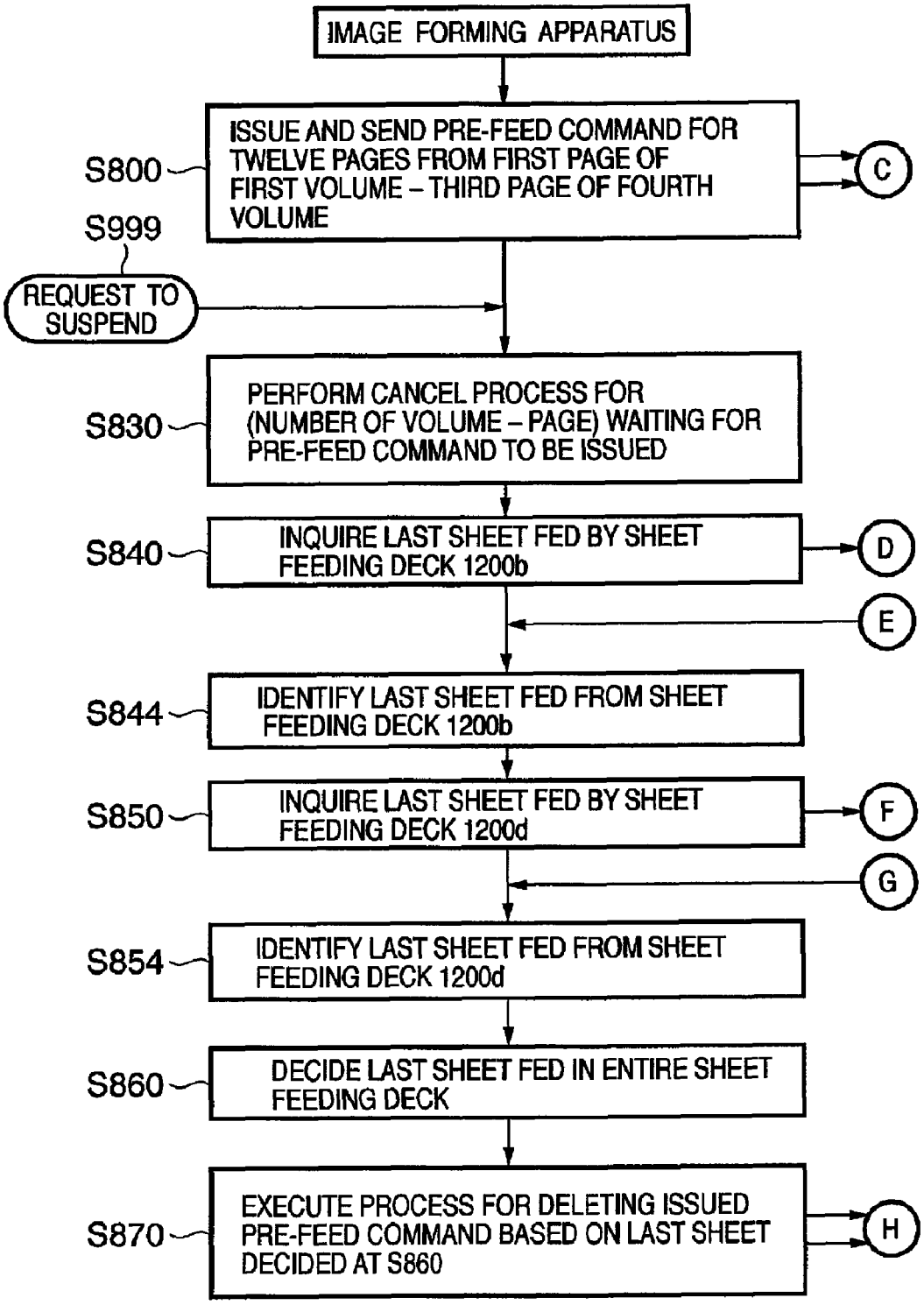
FIGS. 8A AND 8B are flowcharts for illustrating a suspending process of feeding and conveying of sheets to be supplied from a sheet feeding apparatus to the image forming apparatus.
Figure 8B:
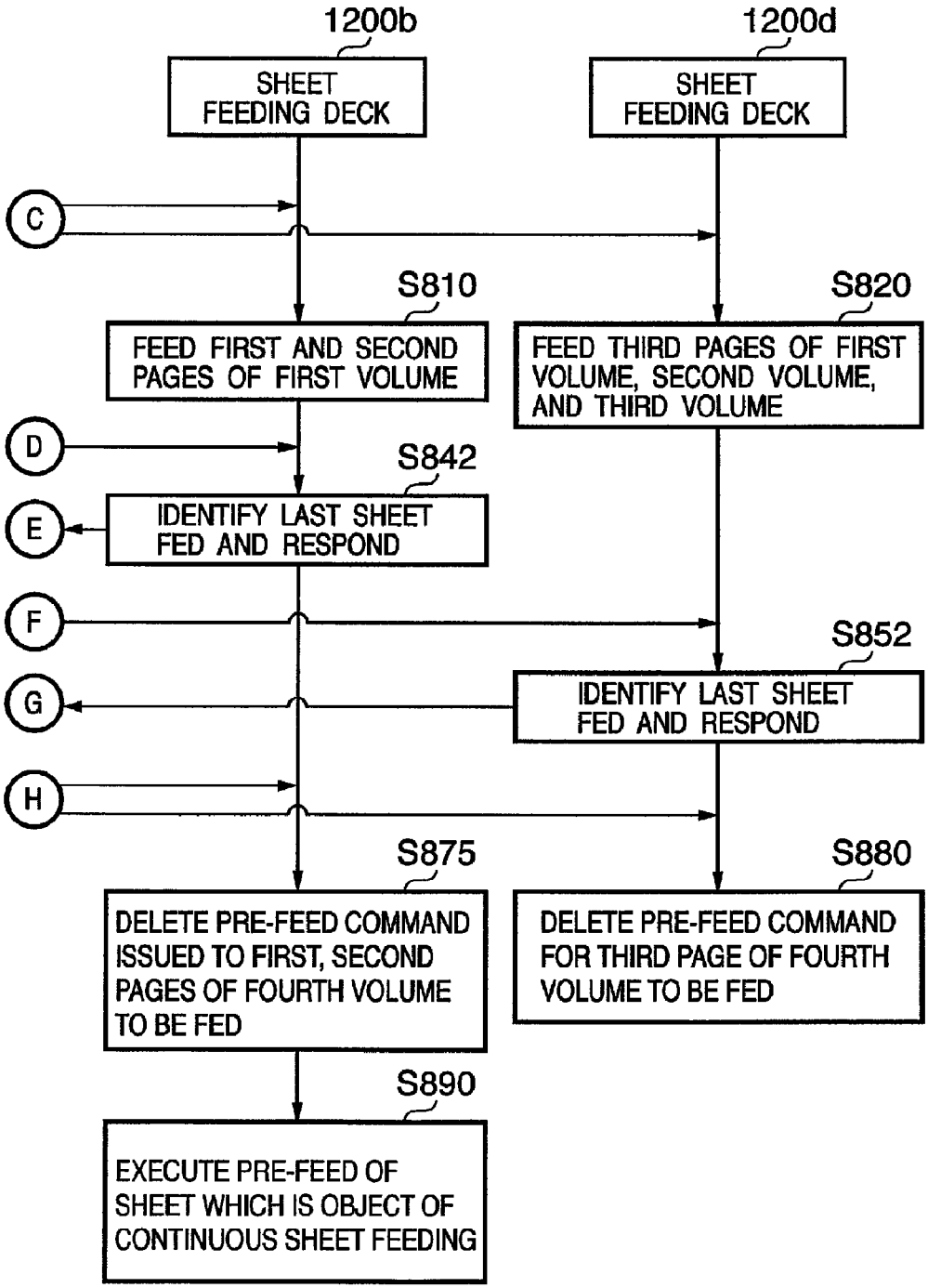

First, at the step S800 of FIG. 8A, the image forming apparatus 100 issues each pre-feed command relating to sheets from the first page (the first page of the first volume) to the twelfth page (the third page of the fourth volume) to the sheet feeding decks 1200*b* and 1200*d*.

The image forming apparatus 100 identifies the necessary number of volumes and the sheet feeding deck for supplying sheets corresponding to the necessary pages (in this case, 1200*b*, 1200*d*) to execute a designated print job.

Then, the image forming apparatus 100 issues and sends a pre-feed command including information on the number of volumes and information on pages to each of the determined sheet feeding decks. When each of the sheet feeding deck receives the pre-feed command, each of the sheet feeding deck starts the pre-feed as described above.

At the step S810, the sheet feeding deck 1200*b* feeds the first and the second pages of the first volume based on the received pre-feed command.

Then at the step S820, the sheet feeding deck 1200*d* feeds the third page of the first volume, the third page of the second volume and the third page of the third volume based on the received pre-feed command. At that moment, sheets other than those mentioned above are in a sheet feeding waiting state against a pre-feed command issued to the sheet feeding decks 1200*b* and 1200*d*.

Figure 9A:
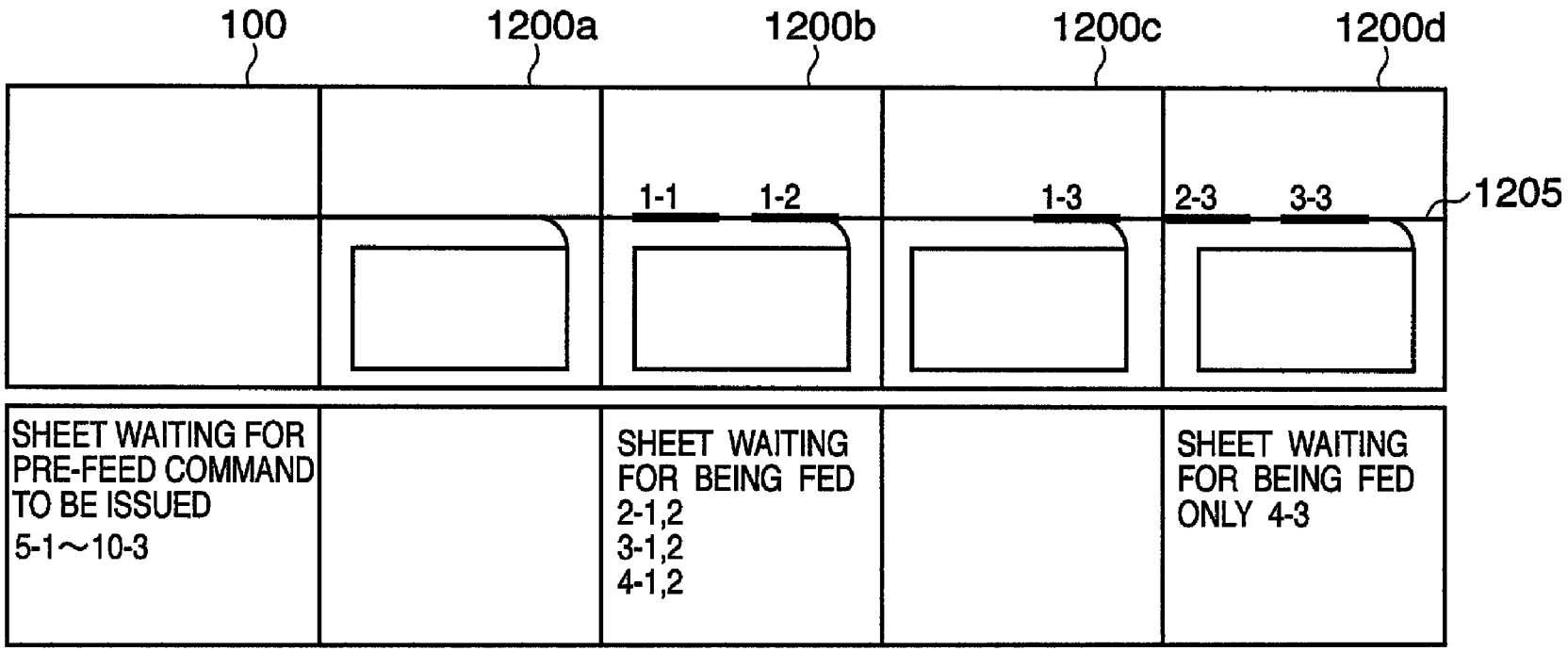
FIG. 9A is a diagram showing a conveying state of sheets fed from sheet feeding apparatuses, sheets waiting for being fed and sheets waiting for a pre-feed command to be issued in the image forming apparatus.

FIG. 9A is a diagram showing a conveying state of sheets fed from sheet feeding decks 1200*b*, 1200*d*, sheets waiting for being fed and sheets waiting for a pre-feed command to be issued in the image forming apparatus 100. In FIG. 9A, the notation of "m-n: m, n are natural number (hereinafter the same)" indicates relationship between the number of volumes and the number of pages. In the figure, the notation of "1-1" indicates the first page of the first volume, the notation of "3-3" indicates the third page of the third volume. In FIG. 9A, sheets (1-1), (1-2), (1-3), (2-3) (3-3) are in a state of being conveyed on the conveyer path 1205 corresponding to the steps S810, S820 of FIG. 8B.

The image forming apparatus 100 is in a state that a pre-feed command till the third page of the fourth volume (4-3) has been issued and a pre-feed command for the rest from the first page of the fifth volume (5-1) to the third page of the tenth volume (10-3) is waited for to be issued.

In the sheet feeding deck 1200*b* of FIG. 9A, sheets ((2-1, 2)), (3-1, 2), (4-1, 2) corresponding to the first and the second page of the second volume, the third volume and the fourth volume are in a state of waiting to be fed. Further, in the sheet feeding deck 1200*d*, the sheet (4-3) corresponding to the third page of the fourth volume is in a state of waiting to be fed.

In a state shown in FIG. 9A, it is assumed that a request to suspend is issued from a suspension key (now shown) of the manipulation unit 203 (S999). The request to suspend is a request to suspend on the assumption that a process in the image forming apparatus 100 described in FIG. 10 resumes.

When the image forming apparatus receives the request to suspend (S999), it performs a cancel process for sheets in a state of waiting for a pre-feed command to be issued so that a new pre-feed command is not issued at the step S830 (delete a pre-feed command).

Next, at the step S840, the image forming apparatus 100 inquires what page of what volume is the last sheet fed from the sheet feeding deck 1200*b*. In response to the inquiry, the sheet feeding deck 1200*b* identifies the last sheet fed from the self device and responds to the image forming apparatus 100 (S842). In such a case, the second page of the first volume (1-2) is the last sheet fed.

Then at the step S844, the image forming apparatus 100 identifies that the last sheet fed by the sheet feeding deck 1200*b* (the number of volume, page) is the second page of the first volume based on information returned from the sheet feeding deck 1200*b*.

Similarly, at the step S850, the image forming apparatus 100 inquires what page of what volume is the last sheet fed from the sheet feeding deck 1200*d*. In response to the inquiry, the sheet feeding deck 1200*d* identifies the last sheet fed from the self device and responds to the image forming apparatus 100 (S852). In such a case, the third page of the third volume (3-3) is the last sheet fed.

Then at the step S854, the image forming apparatus 100 identifies that the last sheet fed by the sheet feeding deck 1200*d* (the number of volume, page) is the third page of the third volume based on information returned from the sheet feeding deck 1200*d*.

At the step S860, the image forming apparatus 100 decides the last sheet fed in the entire sheet feeding decks (the number of volume (m), page (n)). In such a case, the third page of the third volume fed from the sheet feeding deck 1200*d* (3-3) is the last sheet fed.

Next, at the step S870, the image forming apparatus 100 executes the process for deleting an issued pre-feed command based on the last sheet (the number of volume (m), page (n)) decided at the previous step S860.

The image forming apparatus 100 issues a command for deleting a pre-feed command issued to a sheet (n+1) which should be placed after the page (n) in the same volume (m), and sends the command to the sheet feeding decks 1200*b, d.*

Alternatively, the image forming apparatus 100 issues a command for deleting a pre-feed command issued to all pages after the number of volume (m+1) which should be placed after the number of volume (m), and sends the command to the sheet feeding decks 1200*b, d.*

As the last sheet identified by the process at the step S860 is the third page of the third volume, a command to cancel pre-feed commands issued to the sheets after the page, the first, second pages of the fourth volume and the third page of the fourth volume, is sent to each of the sheet feeding decks.

At the step S875, the sheet feeding deck 1200*b* receives a command sent from the image forming apparatus 100, and the sheet feeding deck 1200*b* deletes the pre-feed command issued to the firsts second pages of the fourth volume to be fed.

At the step S880, the sheet feeding deck 1200*d* receives the command sent from the image forming apparatus 100 and the sheet feeding deck 1200*d* deletes a pre-feed command for the third page of the fourth volume to be fed.

Figure 9B:
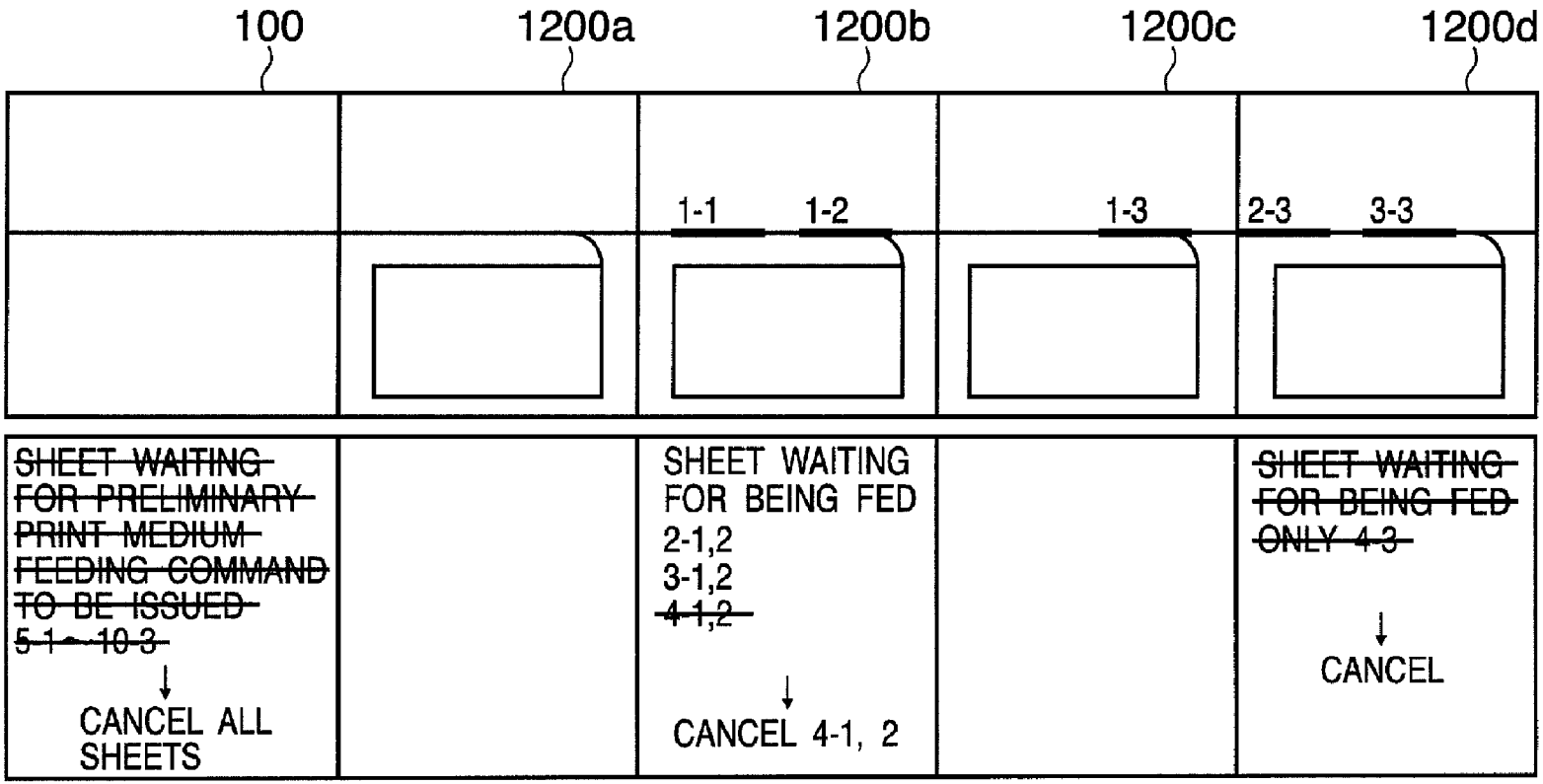
FIG. 9B is a diagram showing a state where a pre-feed command which is waited to be issued is cancelled by the image forming apparatus 100 and an issued pre-feed command is cancelled by sheet feeding apparatuses 1200*b*, 1200*d;*

FIG. 9B is a diagram showing a case where a pre-feed command waiting to be issued is canceled by the image forming apparatus 100 (S830) and an issued pre-feed command is canceled by the sheet feeding decks 1200*b, d* (S875, S880).

The issued pre-feed command is left instead of being deleted with the number of volume and the sheets which should be placed before the last sheet (the number of volume (m), page (n)) decided at the previous step S860 being as an object of continuous sheet feeding.

In the case shown in FIG. 9B, the object of the continuous sheet feeding is the first page and the second page of the second volume and the third volume (2-1, 2), (3-1, 2) by the sheet feeding deck 1200*b.*

Returning the description to FIG. 8B, at the step S890, the sheet feeding deck 1200*b* executes a pre-feed of sheets of the first page and the second page of the second volume and the third volume corresponding to the command based on the issued pre-feed command which is an object of continuous sheet feeding. The specific process of the pre-feed is according to the flowcharts of FIGS. 7A-1 and 7A-2 and timing to start sheet feeding is controlled in conjunction with the other sheets which are already being conveyed.

If a request to suspend occurs during sheet feeding or conveying, only sheets after the last sheet (the number of volume (m), page (n)) which has already been fed are canceled and a pre-feed operation continues for the other sheets waiting to be fed. That makes sheets to be supplied to the image forming apparatus according to the page order so that continuity of the pages to be processed in the image forming apparatus is secured.

With the process, an operation of selecting sheets whose page order is not continuous and discarding the sheets as wastes in resuming suspension or an operation such as page designation in resuming printing are eliminated.

(Resuming Process)

Next, a flow of an ending process which does not need to resume from a suspended state and a stopping process which needs resuming when the image forming apparatus 100 receives a request to suspend (for example, the case where printing is temporally stopped due to running out of toner or the like) will be described with reference to FIG. 10.

In the printing operation, the image forming apparatus 100 determines whether a request to suspend is inputted or not, and if the request to suspend is not inputted (S1000—NO), it monitors whether the request to suspend is inputted or not, while continuing the printing operation.

If the request to suspend is inputted (S1000—YES), the process proceeds to the step S1100, and the image forming apparatus determines the suspension factor.

The suspension factor is determined as the request to end issued by the end key (not shown) of the manipulation unit 203 (S1010—end process), the process proceeds to the step S1020.

At the step S1020, the image forming apparatus 100 deletes the pre-feed command for the sheet waiting for the pre-feed command to be issued so that a new pre-feed command is not issued.

Next, at the step S1030, the image forming apparatus 100 searches for a sheet waiting for being fed among sheets for which pre-feed commands have been issued. The image forming apparatus 100 inquires a sheet waiting for being fed from the sheet feeding decks which are sending a pre-feed command. In response to the inquiry, each of the sheet feeding decks identifies sheets waiting for being fed in the self device and responds to the image forming apparatus 100. The image forming apparatus 100 identifies all sheets waiting for being fed based on the searching result sent from each of the sheet feeding decks.

At the step S1040, the image forming apparatus 100 issues a command for deleting a pre-feed command for the corresponding sheet so that a sheet waiting for being fed searched at the step S1030 is not fed, and send the command to each of the sheet feeding decks. When each sheet feeding deck receives the command to delete a pre-feed command, it deletes a pre-feed command for sheets waiting for being fed in the self device. That prevents all the sheets waiting for being fed from being newly fed.

Each sheet feeding deck continues conveying the sheets on a conveyer path which has already being fed (S1050), the image forming apparatus 100 performs image forming on the sheet which is continuously conveyed (S1060) and the process ends.

Execution of the end process enables a suspension process to be executed with the sheet on which an image has been formed finally discharged from the image forming apparatus by the minimum number of sheets (by the least time period) from the request to suspend, though its page order is different from that of the original document.

On the other hand, at the determination of the step S1010, if the suspension factor is a stopping process for which run out of toner and the like is detected as a cause, the process proceeds to the step S1065.

At the step S1065, the image forming apparatus 100 deletes a pre-feed command for a sheet waiting for a pre-feed command to be issued (for example, (5-1)-(10-3) of FIG. 9A) so that a new pre-feed command is not issued. The process corresponds to the step S830 of FIG. 8A.

Next, at the step S1070, the image forming apparatus 100 searches for the final sheet fed by each of the sheet feeding decks. The image forming apparatus 100 inquires the last sheet fed from each of the sheet feeding decks. The image forming apparatus 100 decides the last sheet fed (the number of volume (m), page (n)) for all the sheet feeding decks based on the responding result from each of the sheet feeding decks in response to the inquiry. Each of the steps of S840-S860 of FIG. 8A addresses the process.

Next, at the step S1080, the image forming apparatus 100 executes the process for deleting the issued pre-feed command based on the last sheet (the number of volume (m), page (n)) decided at the previous step S1070. The process corresponds to the step S870 of FIG. 8A.

That is to say, the image forming apparatus 100 issues a command for deleting a pre-feed command issued for the sheets (n+1) to be placed after the page (n) at the same number of volume (m), and sends the command to each of the sheet feeding decks.

Alternatively, the image forming apparatus 100 issues a command for deleting a pre-feed command issued for all pages after the number of volume (m+1) which should be placed after the number of volume (m), and sends the command to each of the sheet feeding decks.

Each sheet feeding deck receives a command for deleting a pre-feed command sent from the image forming apparatus 100 and deletes the pre-feed command to a sheet in a waiting state as being waiting to be fed in the self device.

At the step S1100, each of the sheet feeding decks executes pre-feed on a sheet for which the pre-feed command has not been deleted. A specific process of the pre-feed is according to the flowcharts of FIGS. 7A-1 and 7A-2 and timing for starting sheet feeding is controlled in conjunction with the other sheets which have already been conveyed.

At the step S1110, the image forming apparatus 100 executes image forming on the sheets for which sheet feeding and conveying continue and the process ends.

If the CPU 201 of the image forming apparatus 100 resumes the process from the stopping state, it requests the sheet feeding decks to feed sheets corresponding to pages after ($m^{th}$ volume, page n+1) which should be placed after the suspended ($m^{th}$ volume, page n: m and n are natural numbers).

Alternatively, the CPU 201 requests sheet feeding decks to feed sheets corresponding to all sheets after $(m+1)^{th}$ volume which should be placed after the suspended ($m^{th}$ volume, page n: m, n are natural numbers).

With the abovementioned stopping process, image formed sheets discharged from the image forming apparatus 100 have continuity of a page order in a document kept and can realize a suspending process by the minimum number of sheets (the least time period) from a request to suspend.

The embodiment enables image forming with pages kept continuous by controlling supplying of sheets corresponding to pages not fed in consideration of pages which have been fed, even if the image forming process by advance feeding is temporally suspended.

Alternatively, it can provide an image forming technique with high productivity kept without making any unwanted sheet by controlling supplying of sheets corresponding to pages not fed in consideration of pages which have been fed, to keep the pages continuous.

Other Embodiments

It is a matter of course that the object of the present invention can be achieved as a storage medium that records program codes of a software program for realizing the abovementioned functions of the embodiment is supplied for a system or an apparatus. It is also a matter of course that it can be achieved as a computer (or a CPU or an MPU) of the system or the apparatus reads and executes the program codes stored in the storage medium.

In such a case, program codes themselves read out from the storage medium realize the abovementioned functions of the embodiment and the storage medium that stores the program codes comprises the present invention.

As the storage medium for providing program codes, a flexible disk, a hard disk, an optical disk, a magneto-optical disk, a CD-ROM, a CD-R, a non-volatile memory card, ROM or the like, for example, can be used.

The abovementioned functions of the embodiment are realized as program codes read by a computer are executed. It is a matter of course that a case where an OS (operating system) or the like running on a computer performs a part or all of the actual processes, based on designation of the program codes and the abovementioned embodiment is realized by the processes can be included.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-258308, filed on Sep. 6, 2005, which is hereby incorporated by reference herein in its entirety.

What is claimed is:

1. An image forming system comprising:

an image forming apparatus;

a first feeding apparatus configured to feed a first recording medium to the image forming apparatus;

a second feeding apparatus placed at a position having a length of a conveyance path to said image forming apparatus longer than a length of a conveyance path from said first feeding apparatus to said image forming apparatus and configured to feed a second recording medium to the image forming apparatus;

a control unit configured to control pre-feeding so that feeding of the second recording medium is started before feeding of the first recording medium, onto which an order of image formation to be performed is earlier than an order of image formation onto the second recording medium, and the second recording medium is conveyed to a predetermined position on the conveying path to said image forming apparatus, wherein, when the control unit determines that a request for suspending image formation has been issued after the second recording medium has been pre-fed from the second feeding apparatus, if the first recording medium, having the earlier order of image formation than the order of image formation onto the second recording medium that has been pre-fed from the second feeding apparatus, has not been fed yet from the first feeding apparatus, the control unit:

controls the first feeding apparatus to feed the first recording medium, having the order of image formation earlier than the order of image formation onto the second recording medium that has been pre-fed from the second feeding apparatus, that has not been fed yet from the first feeding apparatus, and controls the image forming apparatus to execute image formation onto the first recording medium that has been fed from the first feeding apparatus and the second recording medium that has been pre-fed from the second feeding apparatus.

2. The image forming system according to claim 1, wherein the request is issued on the assumption that image formation resumes after ending the suspension.

3. The image forming system according to claim 1, wherein the image forming apparatus forms the image using toner, and the request is issued due to the toner running out.

4. The image forming system according to claim 1, wherein in a case where a request for terminating image formation is issued after the second recording medium has been pre-fed from the second feeding apparatus, the control unit suspends feeding of the first recording medium having the order of image formation earlier than the order of image formation onto the second recording medium that has been pre-fed from the second feeding apparatus, that has not been fed yet from the first feeding apparatus, before the request for terminating the image formation is issued.

5. The image forming system according to claim 1, wherein in a case where the suspended image formation is resumed, the control unit controls the first feeding apparatus and the second feeding apparatus to feed another first or second recording medium having the order of image formation later than the order of image formation onto the second recording medium that has been pre-fed and to which an image formation has been performed.

6. The image forming system according to claim 1, further comprising:

a conveyer path for conveying the first recording medium fed from the first feeding apparatus and the second recording medium fed from the second feeding apparatus, wherein in the pre-feeding, the second recording medium fed from the second feeding apparatus is conveyed to an upstream position to a position converging with the conveyer path where the first recording medium fed from the first feeding apparatus is conveyed.

7. The image forming system according to claim 1, wherein the control unit controls the first and second feeding apparatuses to stop feeding of any subsequent recording medium having the order of image formation following the second recording medium that has been pre-fed from the second feeding apparatus before the request for suspending the image formation was issued.

* * * * *